US006298694B1

(12) United States Patent
Knoll

(10) Patent No.: US 6,298,694 B1
(45) Date of Patent: Oct. 9, 2001

(54) COMBINATION LOCK MECHANISM

(75) Inventor: Yehonatan Knoll, Kiryat Tivon (IL)

(73) Assignee: Knollan Ltd., Kiryat Tivon (IL)

( * ) Notice: Subject to any disclaimer, the term of this patent is extended or adjusted under 35 U.S.C. 154(b) by 0 days.

(21) Appl. No.: 09/508,613

(22) PCT Filed: Apr. 10, 1998

(86) PCT No.: PCT/IL98/00175

§ 371 Date: May 12, 2000

§ 102(e) Date: May 12, 2000

(87) PCT Pub. No.: WO99/14455

PCT Pub. Date: Mar. 25, 1999

(30) Foreign Application Priority Data

Sep. 18, 1997 (IL) ..... 121797

(51) Int. Cl.[7] ..... E05B 37/06

(52) U.S. Cl. ..... 70/25; 70/288; 70/305; 70/316

(58) Field of Search ..... 70/24–28, DIG. 9, 70/288, 289, 301, 304–308, 312, 315, 214

(56) References Cited

U.S. PATENT DOCUMENTS

| | | | | |
|---|---|---|---|---|
| 1,029,820 | * | 6/1912 | Oblein | 70/288 X |
| 2,049,983 | | 8/1936 | Voges | 70/108 |
| 2,491,779 | | 12/1949 | Smith | 70/305 |
| 2,621,509 | * | 12/1952 | Hage | 70/316 |
| 3,602,021 | * | 8/1971 | Martins | 70/25 X |
| 3,756,046 | * | 9/1973 | Jeh | 70/25 |
| 3,832,873 | * | 9/1974 | Barnette | 70/305 X |
| 4,422,311 | * | 12/1983 | Zabel et al. | 70/25 |
| 4,476,698 | | 10/1984 | Treslo | 70/25 |
| 4,732,020 | * | 3/1988 | Peiddeloupe | 70/305 |

FOREIGN PATENT DOCUMENTS 248372 6/1912 (DE) .

* cited by examiner

*Primary Examiner*—Suzanne Dino Barrett
(74) *Attorney, Agent, or Firm*—Nath & Associates PLLC; Gary M. Nath; Marvin C. Berkowitz

(57) ABSTRACT

A combination lock mechanism comprising a housing (20), a locking element (40) fitted with a locking latch (48) and extending into the housing (20), at least two coaxially disposed rotatable locking assemblies (58, 60, 62), each comprising a cogged wheel (68), a locking disc (70) formed with a peripheral recess (84) and a reset element (72) fixable to the cogged wheel (68), a forked locking member (90) pivotally secured within the housing (20) and fitted with first engaging fingers (94), each engaging finger (94) adapted for engagement with the peripheral recess (84) of a corresponding locking disc (70), second engaging fingers (96, 98), each adapted for engagement with a corresponding reset element (72), and a locking lug (140) for locking engagement with the locking latch (48) of the locking element (40). The lock further comprises a manipulating frame (100) displaceable within the housing (20), the arrangement being such that upon predetermined consecutive displacements of the manipulating frame (100) the forked locking member (90) can be shifted to its open position.

22 Claims, 20 Drawing Sheets

FIG.13A
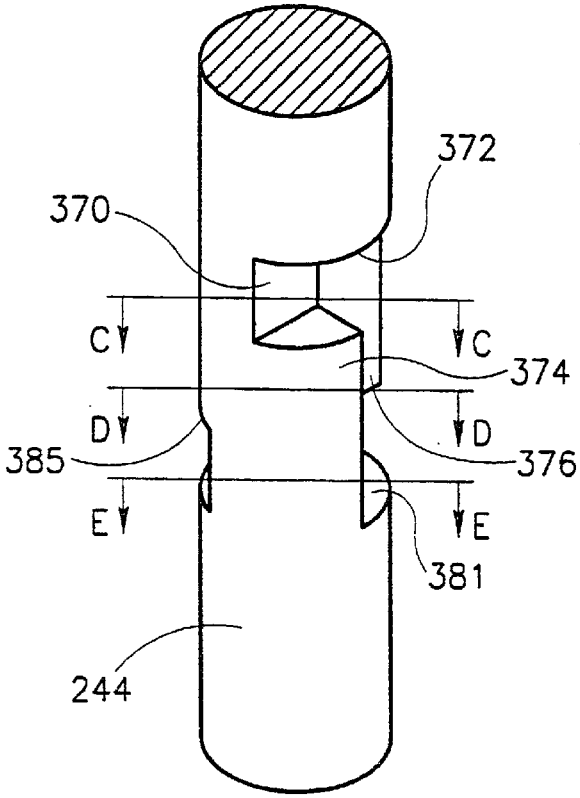
FIG.13B
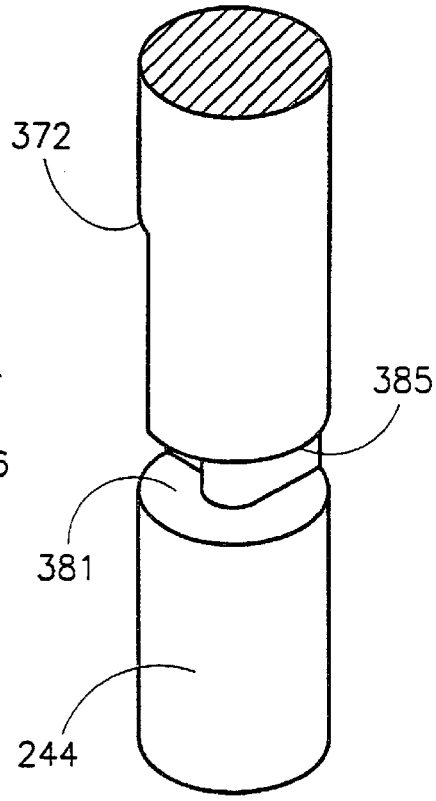
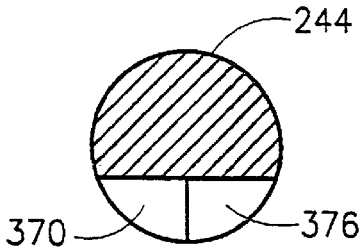
FIG.13C
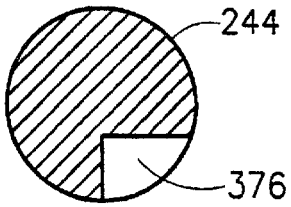
FIG.13D
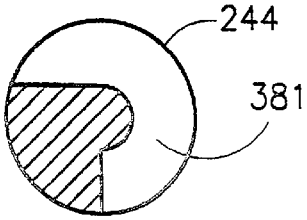
FIG.13E

COMBINATION LOCK MECHANISM

FIELD OF THE INVENTION

The present invention is in the field of locks and more specifically it is concerned with a mechanism for combination locks, at times referred to as key-less locks. Such locks are useful as padlocks, case locks (e.g. suitcases, briefcases), doors, windows, safes, lockers, bicycles and their components, and the like.

BACKGROUND OF THE INVENTION AND PRIOR ART

A combination lock as referred to in the art, is a lock which eliminates the use of a key for opening it. For opening such locks there is typically provided a single dial which should be rotated several times in different directions to reach the correct number forming the combination or by a plurality of dials in which each should be rotated to a position in which the correct combination number appears, or by a plurality of push-buttons which should be pressed in a correct sequence, to reach the right opening combination. The code which enables opening of the lock is at times referred to as a combination code, or an opening code.

A first disadvantage of heretofore known locks resides in that the locking mechanism is arranged in series, i.e. in order to render the locking mechanism some complication, it usually comprises three or more locking assemblies, each of which being separately handled. This arrangement results in that each locking assembly being successfully manipulated into its opening position, renders the picking procedure easier. Even single dial combination locks, although comprising only one manipulating dial, comprise three or more locking assemblies, which are handled in series.

Still a further drawback with prior art locks is the mechanical complexity requiring a plurality of elements, each adapted for manipulating a single locking assembly of a locking mechanism. Furthermore, locking mechanism arranged in series, also require more time for opening.

In addition, in some combination locks, the lock remains unlocked, even if it is closed (the shackle being introduced into its opening within the padlock, or the door of a safe being closed) until positive displacement of at least one manipulating member.

Even more so, most locks require visual contact with the lock to establish manipulation thereof. Obviously, such a requirement may be problematic for blind people or in conditions of darkness. Additionally, in may events it might be required to enable manipulation of a lock using a single hand. Such locks are suitable, in particular for invalids etc. Many other types of locks, in particular security locks, are electrically or electronically operated, the drawbacks of which being obvious.

Known combination or key-less locks are described, for example, in U.S. Pat. Nos. 2,049,983, 2,830,447, 2,931,204, 4,476,698, 4,733,548, 5,109,684 and 5,267,460. However, it is considered that neither of these patents provides an adequate solution for the above referred to drawbacks. U.S. Pat. No. 2,491,779 discloses a combination lock comprising four actuating pins of different lengths, each adapted for engagement in turn with a corresponding lever of the four discs. A manipulating plate displaces each time only one of the levers, thus entailing angular displacement of a single disc at a time to the extent of one notch at a time.

It is the object of the present invention to provide a combination lock mechanism, in which the above referred to disadvantages are significantly reduced or overcome and which allow easy manipulation of the lock single handed and without visual contact with the lock.

GENERAL DESCRIPTION OF THE INVENTION

According to the present invention, there is provided a combination lock mechanism comprising a housing, a locking element fitted with a locking latch and extending into the housing; at least two coaxially disposed rotatable locking assemblies each comprising a cogged wheel, a locking disc formed with a peripheral recess and being fixable to the cogged wheel, and a reset element fixable to the cogged wheel; a forked locking member pivotally secured within the housing and fitted with first engaging fingers, each adapted for engagement with the peripheral recess of a corresponding locking disc, second engaging fingers, each adapted for engagement with a corresponding reset element, and a locking lug for locking engagement with the locking latch of the locking element; the forked locking member being displaceable between a locking position in which the locking lug arrests the locking latch, an opening position in which each of the first engaging fingers is engaged within the peripheral recess of a corresponding locking disc and the locking lug disengages from the locking latch, and a reset position in which each of the second engaging fingers engages a corresponding reset elements entailing its displacement into a reset position; a manipulating frame displaceable within the housing and comprising at least two arms, each arm fitted with inward lateral projecting teeth displacement blades, each corresponding with one of the cogged wheels, the arrangement being such that upon predetermined consecutive displacements of the manipulating frame the displacement blades encounter teeth of a respective cogged wheels entailing respective angular displacement of each of the at least two rotatable locking assemblies into a position in which all the peripheral recesses are aligned, thus allowing the forked locking member to shift into its open position.

The combination in accordance with the present invention may be suitable for use as a padlock or as a lock for locking any two elements swingable with respect to one another, e.g. for use in suitcases or briefcases, doors, windows, safes, etc.

According to a first embodiment the three components of each locking assembly are made integral with one another, either as a solid piece or by attachment to one another.

By a preferred embodiment of the present invention, the manipulation frame is manipulated by a single manipulating knob projecting from a front wall of the housing.

In accordance with the present invention, the forked locking member in its opening position is biased in a direction enabling the first engaging fingers to engage within the peripheral recess of the corresponding locking discs; and at the resetting position the forked locking member is biased in a direction so that the second engaging fingers engages the corresponding reset elements.

According to a preferred application, the forked locking member is fitted with a leaf-spring received within a corresponding recess in the locking element, whereby extracting displacement of the locking element from the housing entails biasing of the forked locking member into the opening position; and retracting displacement of the locking element with respect to the housing entails biasing of the forked locking member into the resetting position.

In accordance with the preferred embodiment of the present invention, the manipulating frame is biased into a neutral position, in which the displacement blades are disengaged from the teeth of the cogged wheel. In accordance with one application, at least two non-diagonally disposed arms of the manipulating frame are each biased by a spring member fixed to the housing in a manner so as to allow displacement of the respective arm along a first axis, and bias it into the neutral position when displaced along a second axis perpendicular to said first axis.

By still preferred embodiment of the present invention, the manipulating frame is displaceable in a cross-like pattern, wherein the front wall of the housing is formed with a cross-like aperture, allowing displacement of the manipulating knob in a cross-like pattern.

In order to stabilize the manipulating frame within the housing, the back wall of the housing is formed on its inner face with a supporting cross-like groove, corresponding with each arm of the manipulable frame and corresponding in shape with the displacement thereof.

In a preferred embodiment of the present invention, the lock comprises three rotatable locking assemblies constituting together a locking mechanism, and a manipulating frame comprises four arms. Preferably, the three locking assemblies are mounted on an axle extending from a rear wall of the housing and arranged in a compact manner in which one member of a first locking assembly is mounted adjacent the same member of an adjacent locking assembly.

According to a specific design teeth othe cogged wheel are curved at both edges thereof, and where the edges of diagonally opposed displacement blades each extend at a different plane.

By a preferred design, the cogged wheels are designed each having different shaped teeth and differently spaced from one another, thus increasing the number of locks which may be made in each batch of manufactured locks.

By a preferred application of the present invention, each reset element is formed in a drop-like shape having a flat base, where engagement with the second engaging fingers of the forked locking member, at any angular position, entails rotation of the reset element to a position in which said fingers are flush with said flat base. This arrangement ensures that engagement of the second engaging fingers causes rotation of the reset elements into the position in which the fingers are flush with the flat base, whereby a predetermined reset position is reached.

Preferably, at the locked position, the first and second engaging fingers are disengaged from the locking discs and the reset elements, respectively, whereby force applied to the shackle is not transmitted to the locking assemblies. By still a preferred embodiment of the present invention, one of the elements constituting the locking assembly, i.e, the cogged wheel, the locking disc and the resetting element, of at least one of the rotatable locking assemblies, is angularly displaceable with respect to the others so as to establish a new opening combination. Preferably, the reset element is displaced with respect to the locking disc.

In accordance with this embodiment, in order to obtain a fixed angle position of the rotatable elements within a locking assembly, the faces of adjacent members are provided with surface engaging means, such as corresponding bulges and receiving indentions or a plurality of ribs and corresponding recesses, angularly disposed, so as to allow contact surface of two adjacent elements at a variety of angular displacements.

BRIEF DESCRIPTION OF THE DRAWINGS

For better understanding, the invention will now be described in a non-limiting manner, with reference to the accompanying figures, in which:

FIGS. 13A and 13B are isometric views of a lower portion of a locking leg of the shackle at two angular positions;

FIGS. 13C–13E are cross-sections along lines C—C, D—D and E—E, respectively in FIG. 13A;

DETAILED DESCRIPTION OF SPECIFIC EMBODIMENTS

Figure 1:
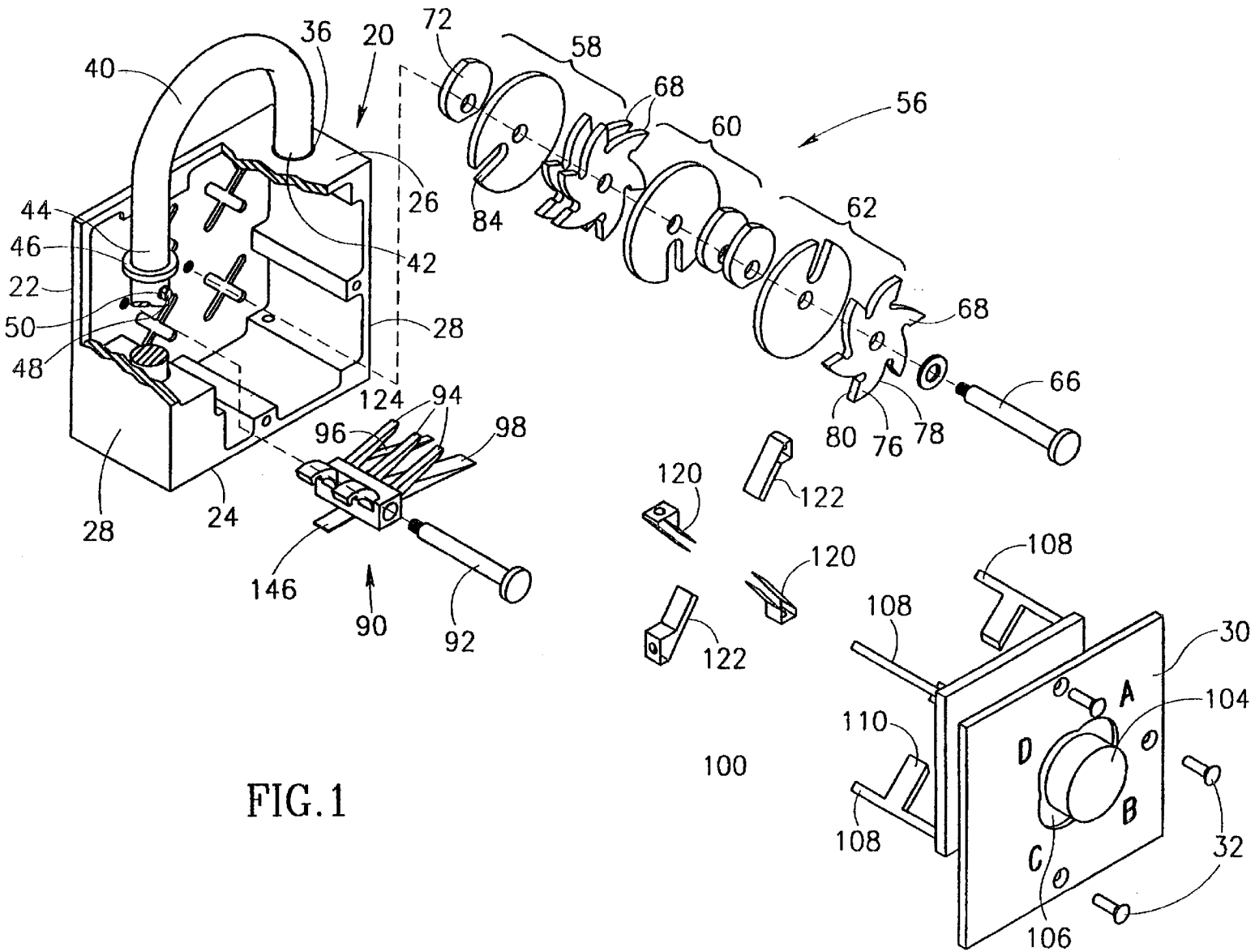
FIGS. 1 is a perspective, exploded view of a padlock in accordance with the present invention, in which for sake of clarity, the housing is partially cutout.

Attention is first directed to FIG. 1 of the drawings, in which the combination lock is illustrated in the form of a padlock comprising a housing 20 having a back wall 22, a bottom wall 24, a top wall 26, side walls 28 and a removable front wall 30 which may be fixed to the housing 20, for example, by rivets 32 or screws.

Figure 5:
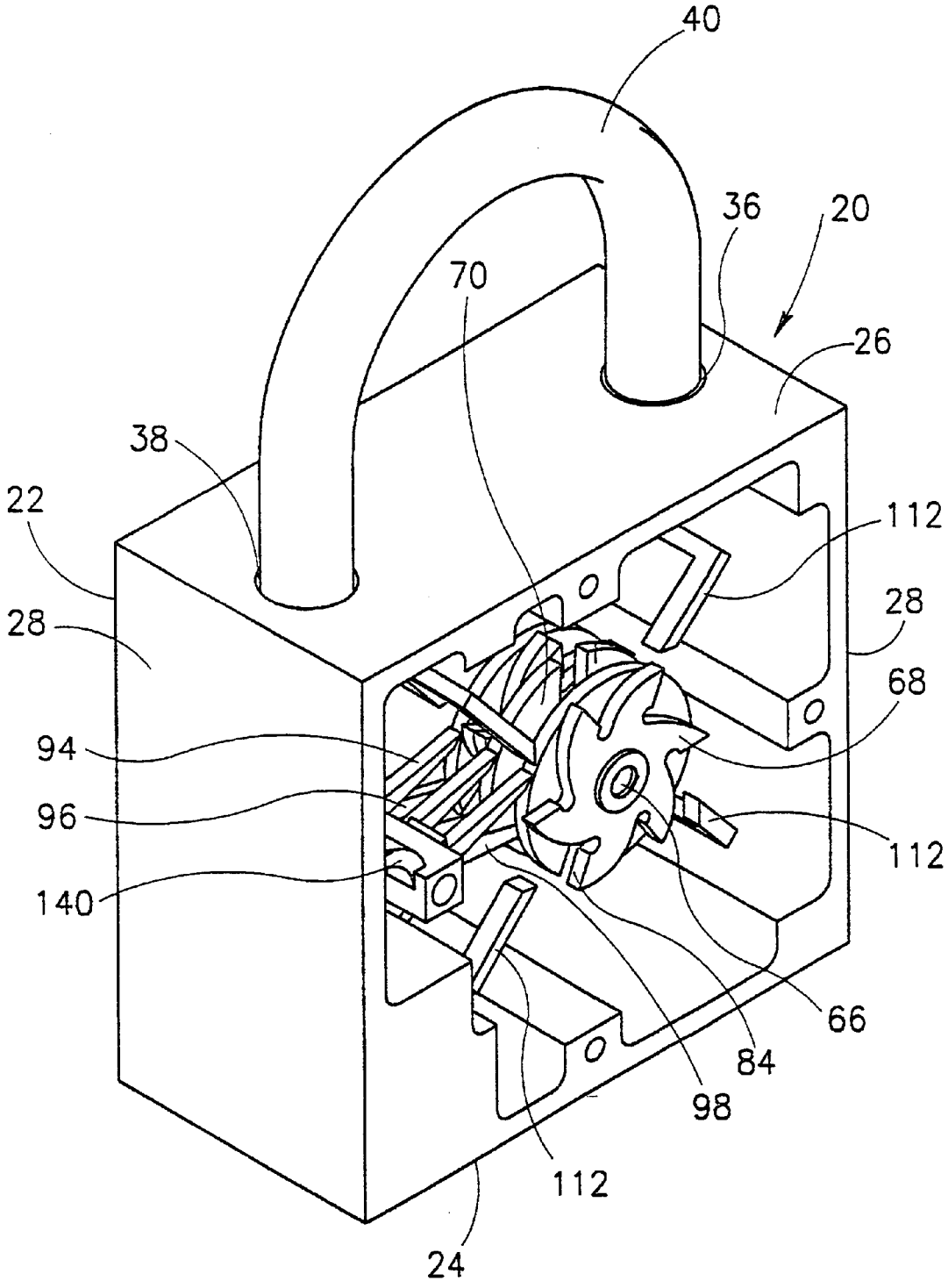
FIG. 5 is a perspective view of a padlock in accordance with the present invention with front wall and manipulating plate removed, but the manipulating displacement blades remain.

As can be seen better in FIG. 5, the top wall 26 has two openings 36 and 38 for receiving a U-like shaped shackle 40, having one short leg 42 and one long leg 44, as known, per se. The long leg 44 is received within the housing 20 and is fitted near its upper end with a ring 46 for preventing the shackle 40 from unintentional withdrawal from the housing 20. Two locking latches 48 (only one of which is seen) laterally project from the leg 44, each having a top end 50 with chamfered edges serving as gliding surfaces. A groove 51 is formed at a lower portion of leg 44 of the shackle 40 for the reason to become apparent later.

A locking mechanism generally designated 56 comprises three independently rotatable locking assemblies 58, 60 and 62, coaxially mounted on a shaft 66 which in turn is screw fitted into the back wall 22 of the housing 20. Each of the locking assemblies comprises a cogged wheel 68, a locking disc 70 and a reset element 72. Although in FIGS. 1, 2B, 6B and 7B the cogged wheel, the locking disc and the reset element are illustrated in an exploded view, it should be realized that in reality they are either made as a solid unit or, in accordance with the second embodiment of the invention, as separate elements fixedly attached to one another to form a rotatable locking assembly. It should, however, be realized that the order of the components of each locking assembly may vary, mutatis mutandis. It should further be understood the reset element 72 may have a shape different than the droop-like shape illustrated in the Figures.

Each of the cogged wheels 68 is fitted with a plurality of differently shaped teeth 76, each formed with a curved surface 78 and a straight, radially extending face 80. Each of the locking discs 70 is formed with a radially extending peripheral recess 84 and each of the reset elements 72 has a drop-like shape with a flat portion 86. It will be appreciated that the cogged wheels 68 of each of the locking assemblies 58, 60 and 62 are different and, still preferably, each of the elements constituting said rotatable elements 58–62 is disposed in a different angular orientation.

The locking mechanism 56 further comprises a forked locking member generally designated 90, which is pivotally secured within he housing 20 by a shaft 92 screw fitted to the rear wall of the housing 20. The locking member 90 comprises three first engaging teeth 94 and two second engaging teeth 96 and 98, the latter being wider than the former.

Figure 12A:
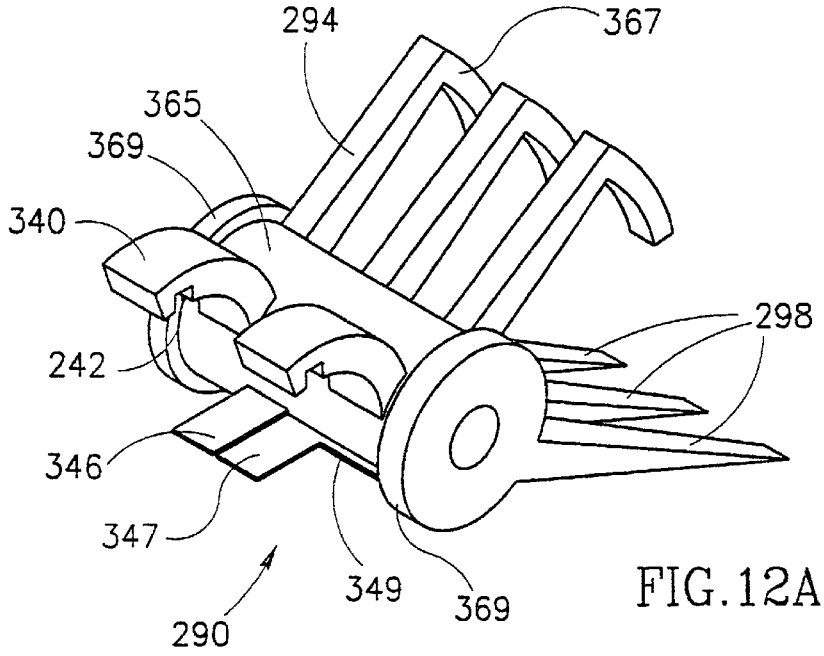
FIG. 12A is a perspective assembly of a locking member in accordance with the second embodiment.
Figure 12B:
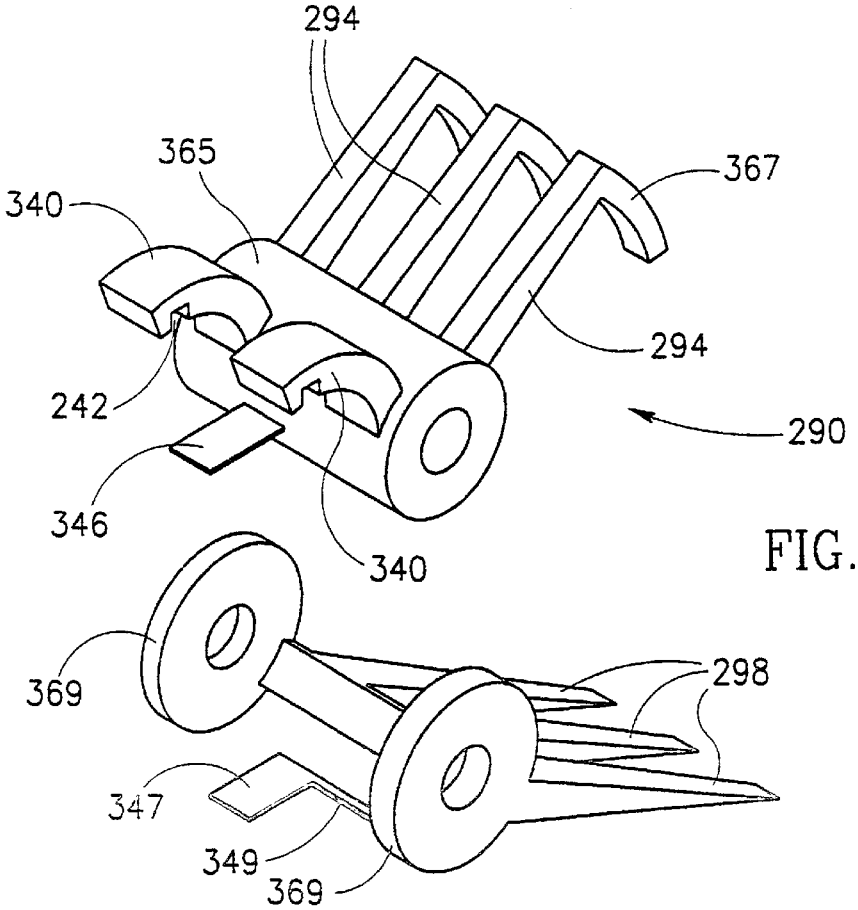
FIG. 12B is perspective exploded view of the locking member seen in FIG. 12A.

The forked locking member 90 may be manufactured of several components as illustrated in the embodiment of FIG. 12B.

Figure 4:
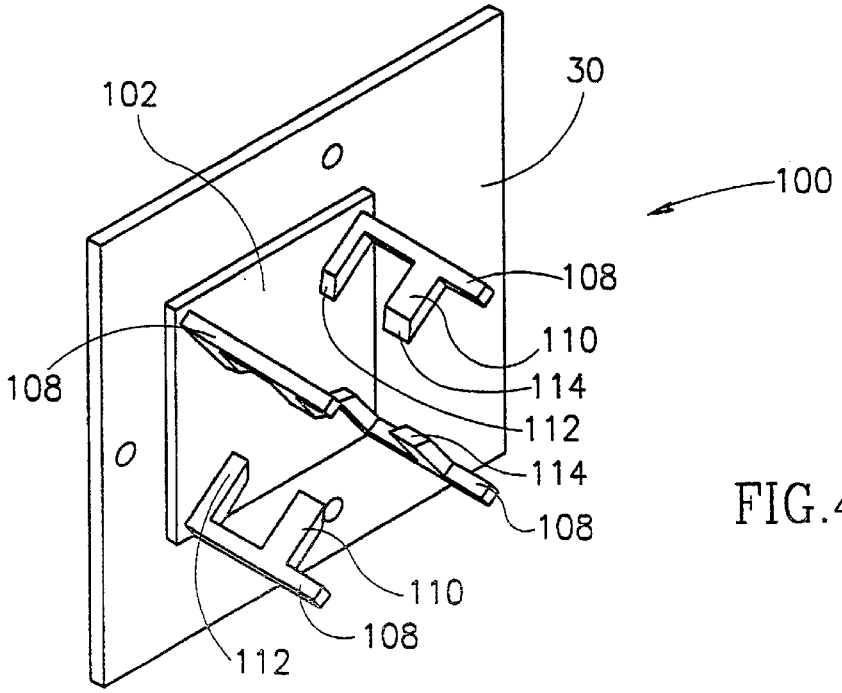
FIG. 4 is a perspective view of a front wall and the manipulating member of the lock seen in FIG. 1, viewed from the inner side.

The lock further comprises a manipulating frame 100 comprising a manipulating plate 102 having a manipulating knob 104 projecting through a cross-like shaped opening 106 within front cover 30. As can best be seen in FIG. 4, the manipulating plate 102 is fitted with four legs 108, each comprising inward facing displacement blades 110 and 112, the latter being narrower than the former, and each having an inclined end 114.

The arrangement is such that the manipulating frame 100 is displaceable within the housing 20, with its manipulating plate 102 remaining essentially parallel to front plate 30, the manipulating member 100 displaceable in a cross-like pattern defined by the shape of opening 106 within the front plate 30. In order to further stabilize the manipulating frame 100, the inner face of back wall 22 is formed with four cross-like shaped guide groves 131 adapted for receiving and guiding the free ends of the legs 108 of the manipulating member.

Figure 8B:
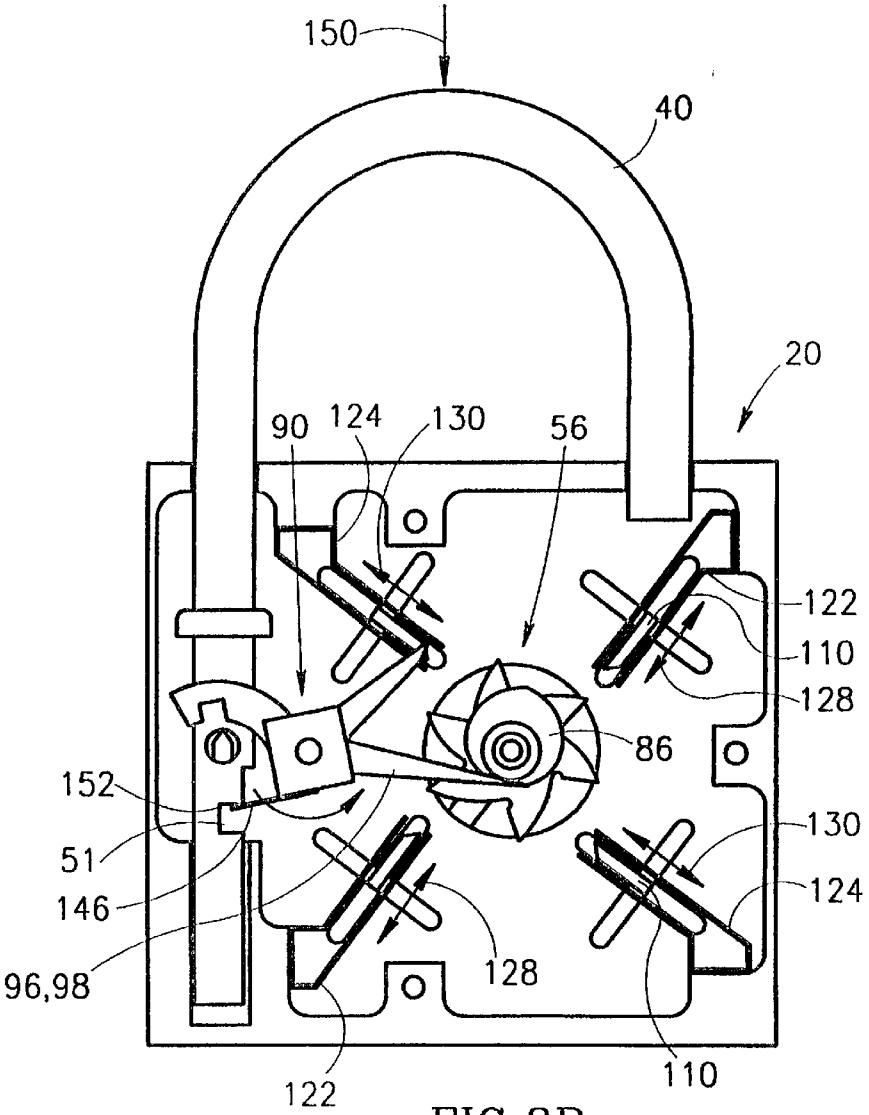
FIGS 8A to 8E are front elevations of a padlock in accordance with the present invention with the front wall and the manipulating plate removed, illustrating four consecutive steps of resetting and opening the lock.
Figure 8A:
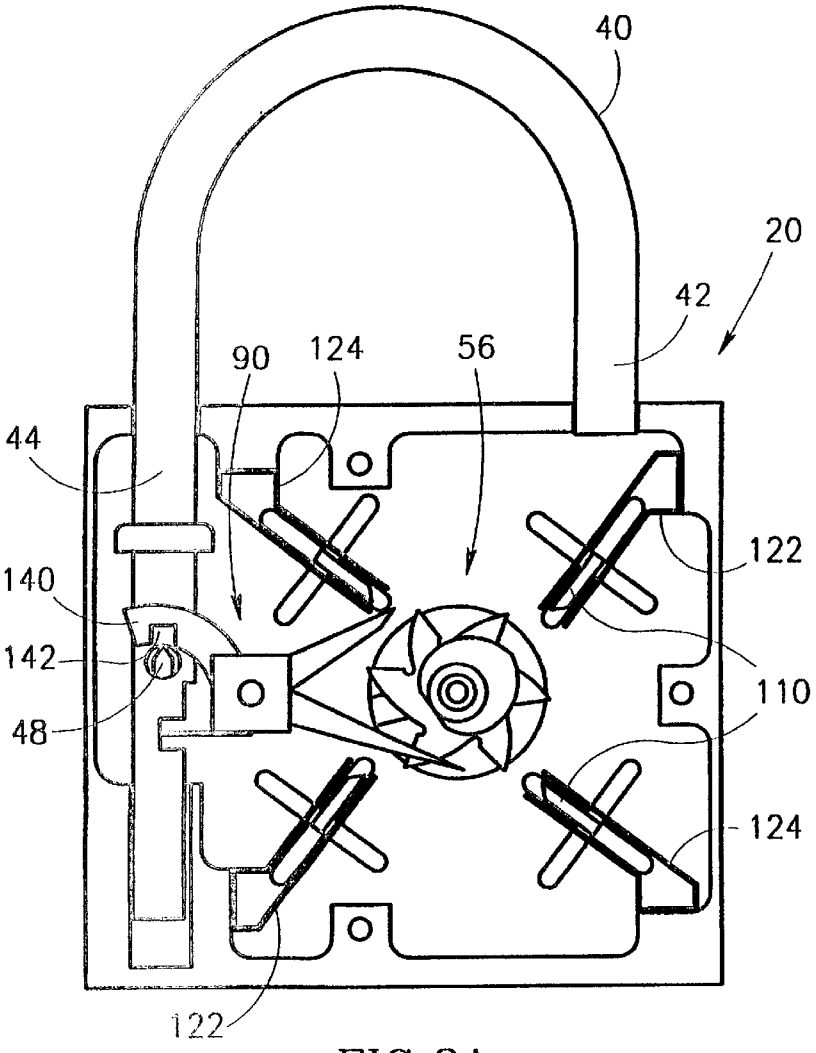
Figure 8D:
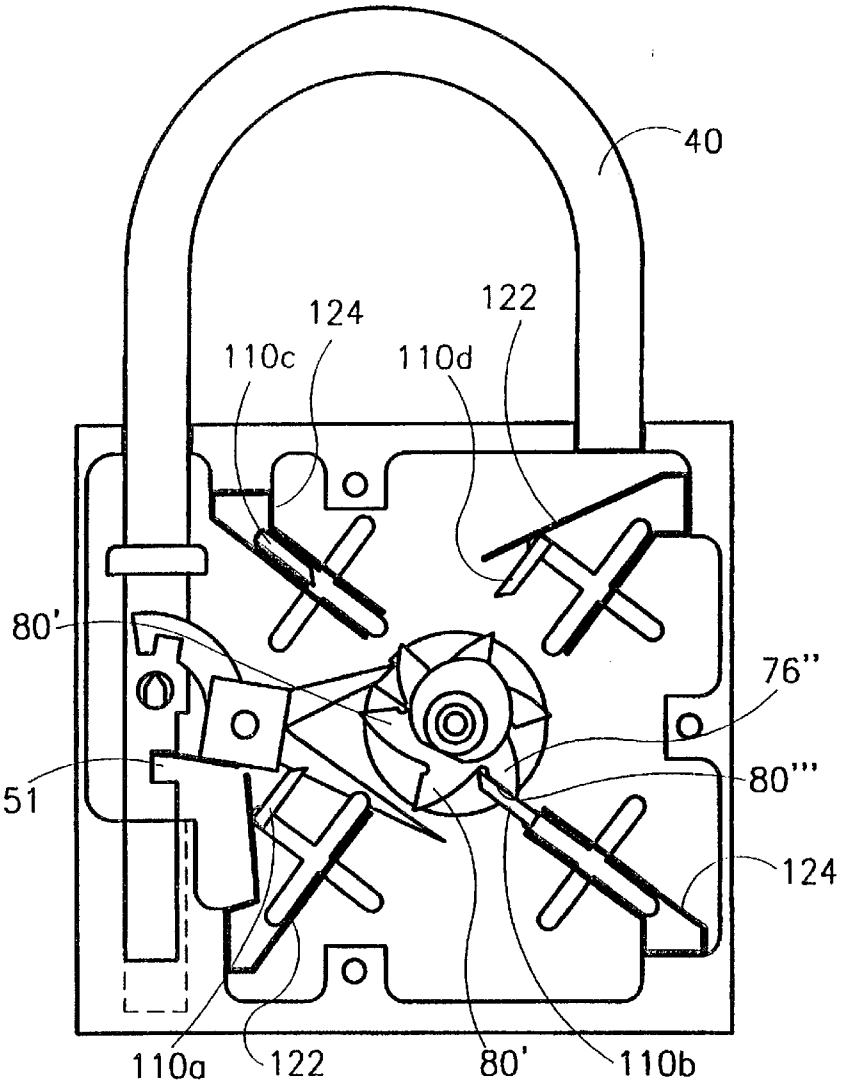

In order to ensure that the manipulating frame 100 returns to its neutral position seen in FIG. 1, i.e. a position in which the frame is centrally located within the housing 20, four inverted U-like leaf springs 120 and 122 are secured by screws (not seen) to the housing 20 at respective back corners of the housing (one mounting location 124 of a spring 120 is seen in FIG. 1). As can be seen in FIGS. 8 and 9A, the springs 120 and 122 are secured within the housing 20 with their open side facing inward, each two diagonally opposed springs being parallel to one another.

Figure 8C:
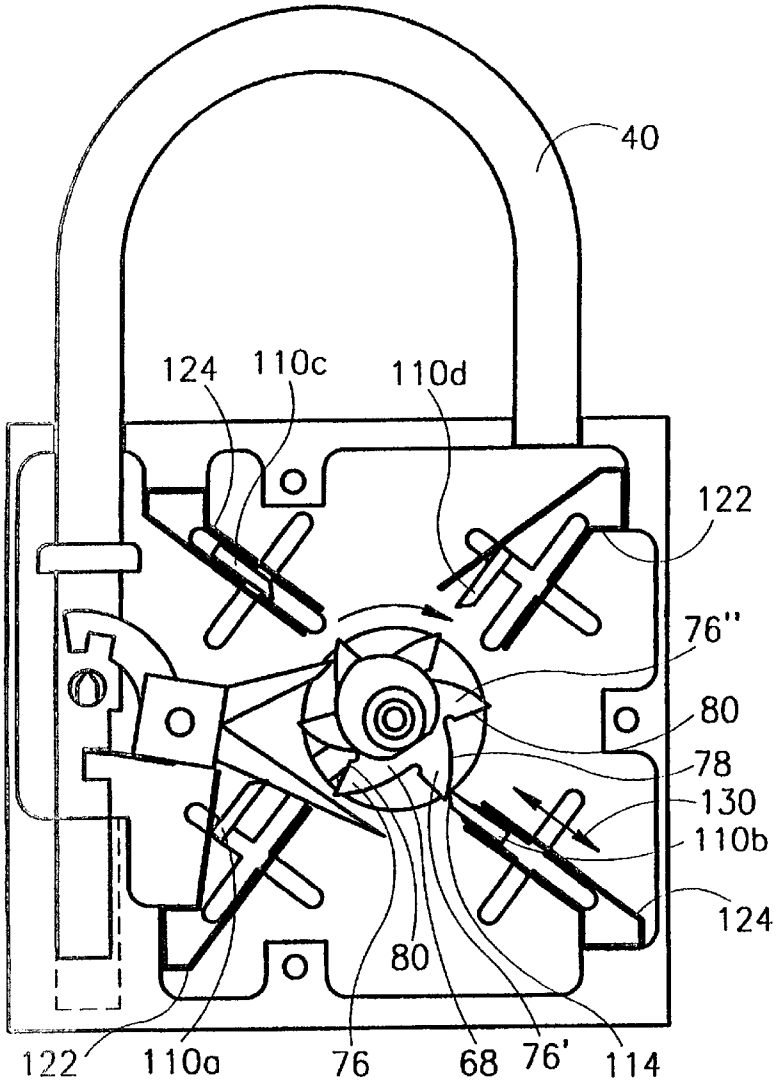
Figure 8E:
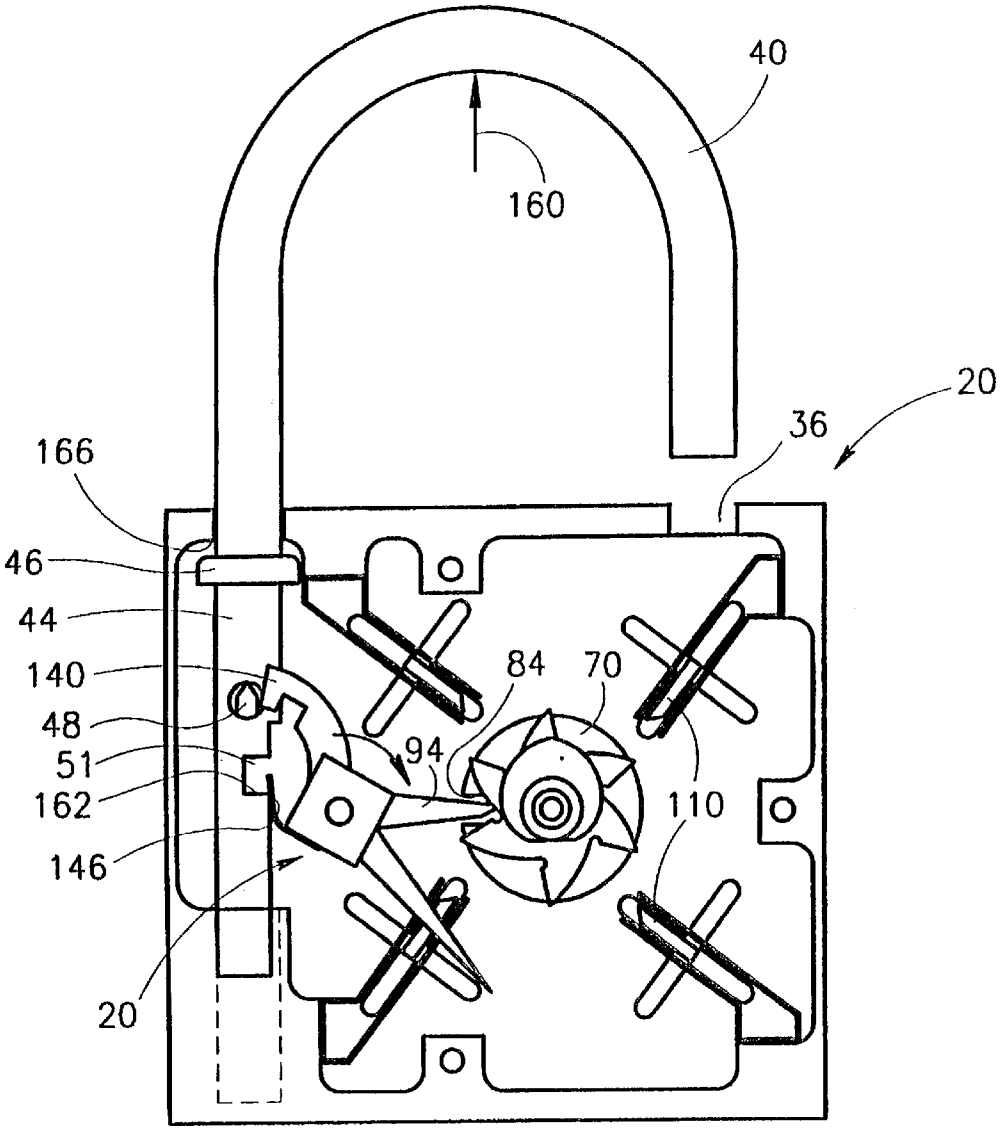
Figure 9A:
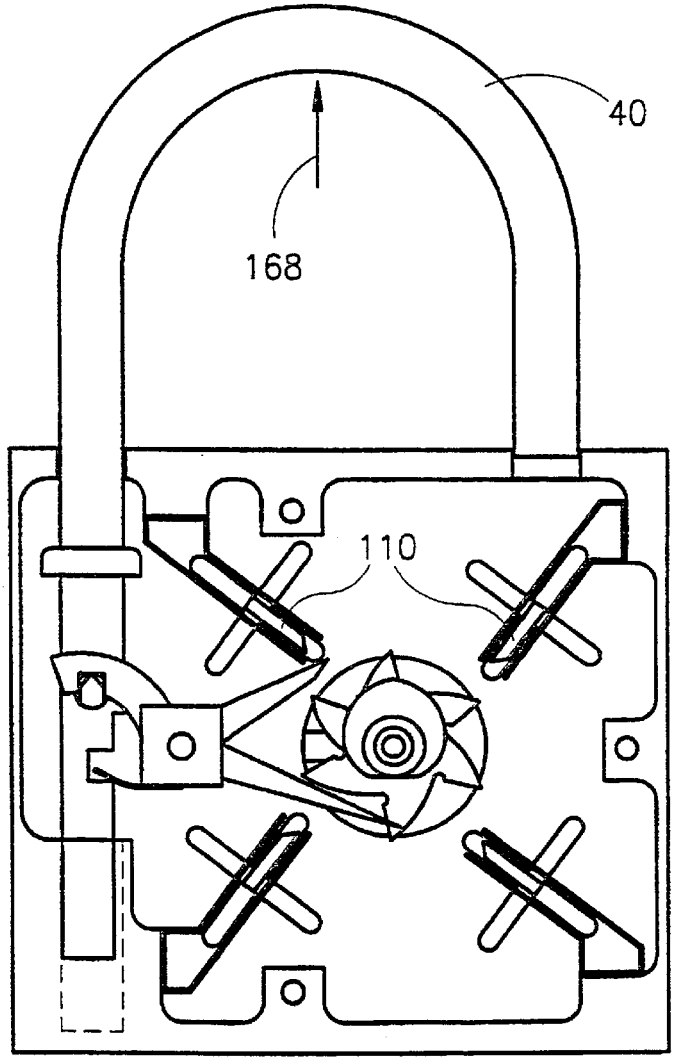
FIG. 9A is a front elevation of a padlock in accordance with the present invention with the front wall and manipulating plate removed, illustrating the padlock in its locked position.

As best understood from FIG. 8C, the arrangement is such that the free end portion of legs 103 of the manipulating frame 100 are adapted for being snugly received within the openings of the springs, whereby the pair of springs 122 permit free displacement of the manipulating plate along a first direction diagonally extending within the housing 20 and indicated by arrow 128, whereas the manipulating frame 100 is biased into a mid position of a second diagonal direction perpendicular to said first diagonal direction and represented by arrows 130. In a similar but reversed manner, the springs 124 allow free displacement of the manipulating frame 100 in the direction of arrows 130, but bias it into its mid position in the direction of arrows 128. A specific example is illustrated and explained with reference to FIGS. 8C and 8D. The outcome of this arrangement is that the manipulating frame 100 is normally biased into a neutral position and being displaceable into any one of the four transverse directions, as explained hereinabove.

As can further be seen in FIGS. 1 and 2, the forked locking member 90 is formed at its backside with two spaced apart locking lugs 140 each formed at a bottom face thereof with a recess 142 fitted for arresting the locking latch 48 of the shackle 40, as will hereinafter be explained. The forked locking member 90 further comprises a leaf spring 146 rearwardly extending with respect to the first and second engaging fingers.

Figure 6A:
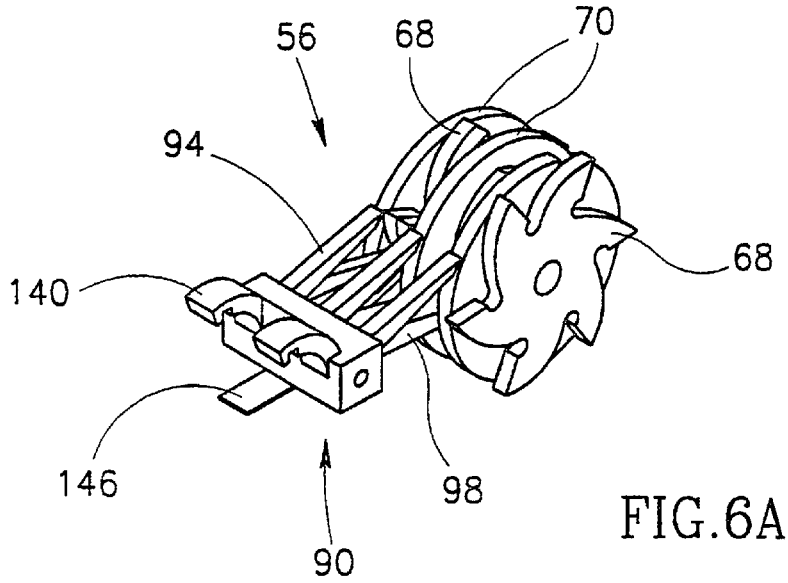
FIG. 6A is a perspective view of the locking assemblies engaged with the locking member, in the resetting position.
Figure 7A:
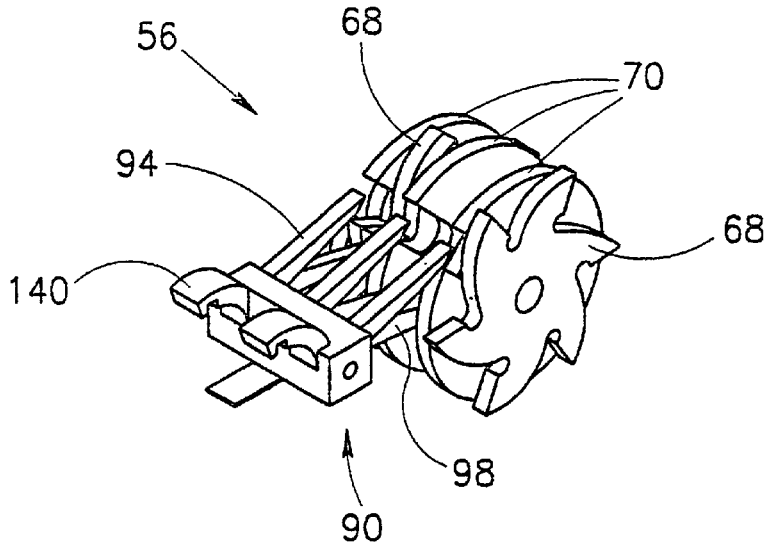
FIG. 7A is an isometric view of the locking assemblies engaged with the locking member opening position.
Figure 7B:
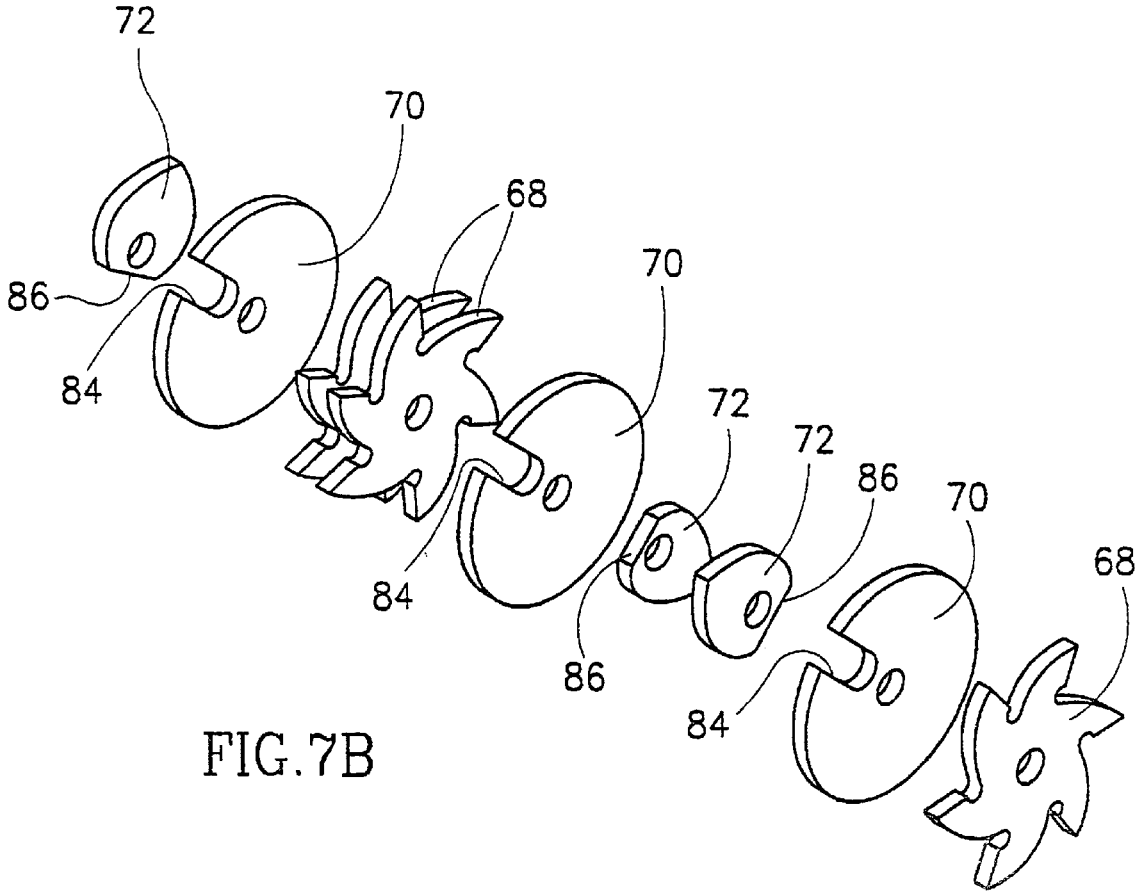
FIG. 7B is an exploded view of the locking assemblies in their opening position.

In the assembled position, the locking mechanism 56 is so arranged that the first engaging fingers 94 are adapted for interlacing engagement within the peripheral recess 84 of a corresponding locking disc 70 and the second engaging fingers 96 and 98 are adapted for interlacing engagement with the resetting elements 72. However, since the resetting elements of the locking assembly 60 and 62 are adjacent one another, the second engaging finger 98 is of extended width, so as to engage with both reset elements 72, as can best be seen in FIGS. 5, 6A and 7A.

The assembly of the locking assemblies 58, 60 and 62 of the locking mechanism 56 is such that the cogged wheels 68 of locking assemblies 53 and 60 are disposed adjacent one another, and accordingly displacement blade 110 of the manipulating frame 100 is wider than the displacement blade 112 which is adapted for engagement only with the front-most cogged wheel 68 of the locking assembly 62.

Figure 3:
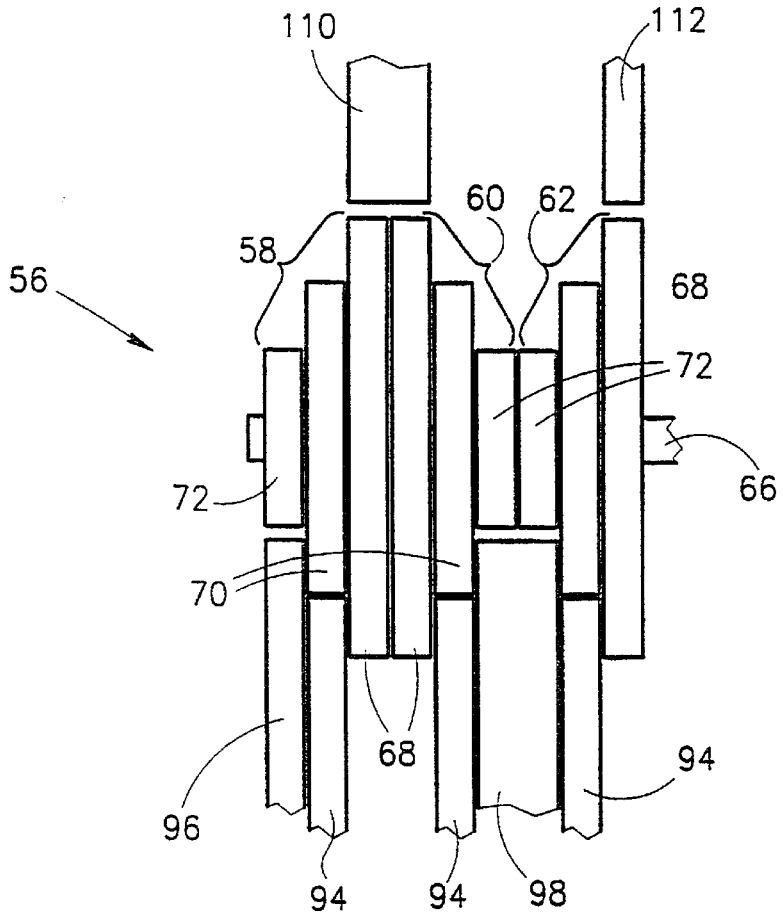
FIG. 3 is a schematical side elevation of the locking assemblies inter-engaged with the first and second engaging fingers of the forked locking member and with displacement blades of the manipulating member.

A schematical layout illustrating the different corresponding relations between the locking assemblies, the first and second engaging fingers and the displacement blades of the manipulating frame is illustrated in FIG. 3. Two cogged wheels 68 are adjacent one another and are engageable by corresponding displacement blade 110 of the manipulating frame 100 and a third cogged wheel 68 is engageable by the narrow displacement blade 112. Three first engaging fingers 94 are each adapted for engaging with a corresponding locking disc 70 and a narrow second engaging finger 96 is adapted for engaging one re-set element 72 of the locking assembly 58 and a wider second engaging finger 98 adapted for engaging adjacent re-set elements 72 of locking assembly 60 and 62. It should be readily understood to a skilled person that other arrangements of the locking assemblies and the corresponding engaging members are possible too, all falling within the scope of the present invention.

For understanding how the lock in accordance with the present invention operates, attention will now be directed to some of the FIGS., but in particular to FIGS. 2, 6, 7, 8 and 9. In FIG. 8A the lock is seen in an arbitrary locked position, in which both leg portions 42 and 44 shackle 40 are received within the housing 20 with the recess 142 of the locking lugs 140 extending above the locking latch 48 of the shackle 40, thus preventing extraction of the shackle from the housing. The chamfered edges of the top portion 50 of the locking latches 48 ensure engagement the recess 142 of the locking lugs 140, even if the recesses 142 are not exactly aligned with the locking latches.

Figure 2A:
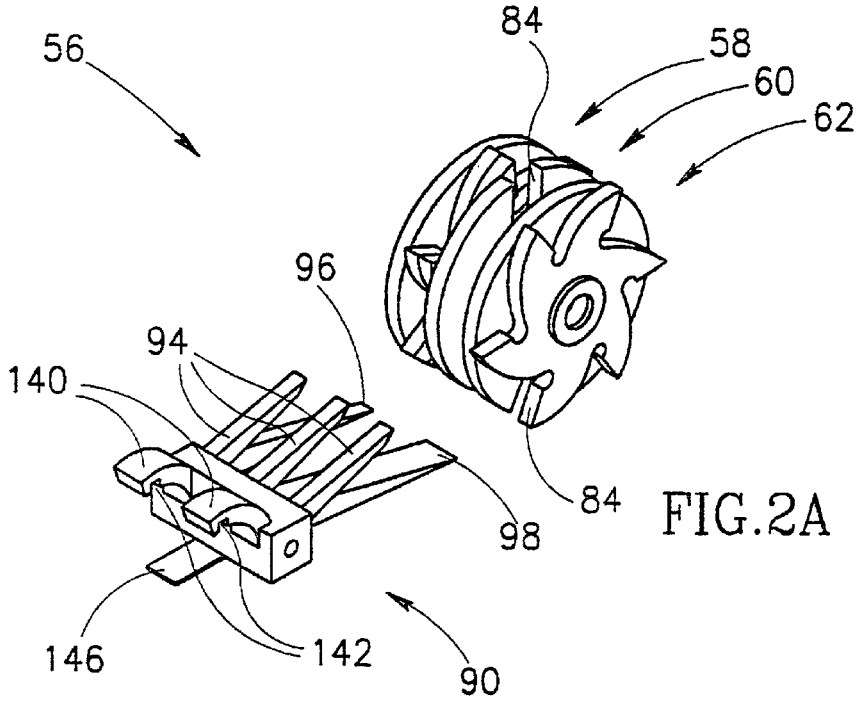
FIG. 2A is isometric view of three locking assemblies and the locking member seen in FIG. 1.
Figure 2B:
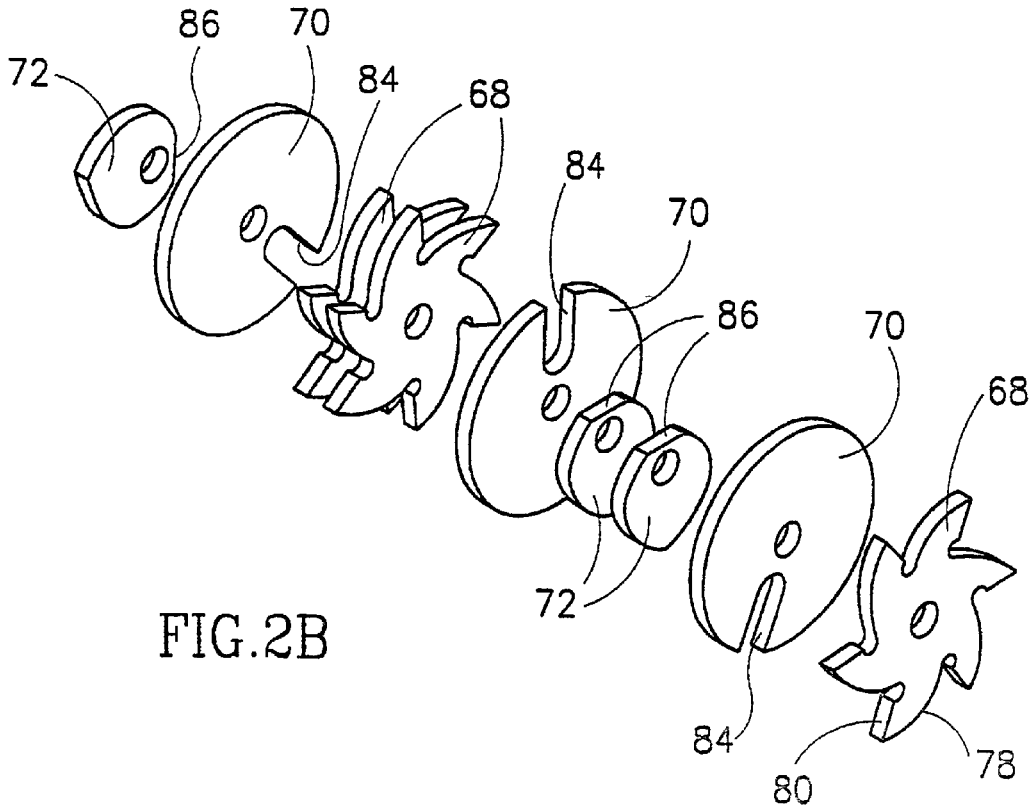
FIG. 2B is an exploded view of the locking assemblies seen in FIG. 2*a;*

By using the term arbitrary position, it is referred to the angular displacement of the three locking assemblies 58, 60 and 62 and as can be seen in FIGS. 2A and 2B, neither of the locking discs 70 or the resetting elements 72 are aligned with one another (this position remains also if only two of which are not aligned). It will be appreciated that in this position the locking element 90 cannot spontaneously rotate in a clockwise direction to an unlocked position where the first engaging teeth 94 engage with the recesses 84 of the locking discs 70, as long as the three locking discs are not aligned, as will hereinafter be illustrated. As can further be seen in FIG. 8A, the manipulating plate, (of which only displacement blades 110 are seen in FIGS. 8), is in its neutral position, as explained hereinabove.

Figure 6B:
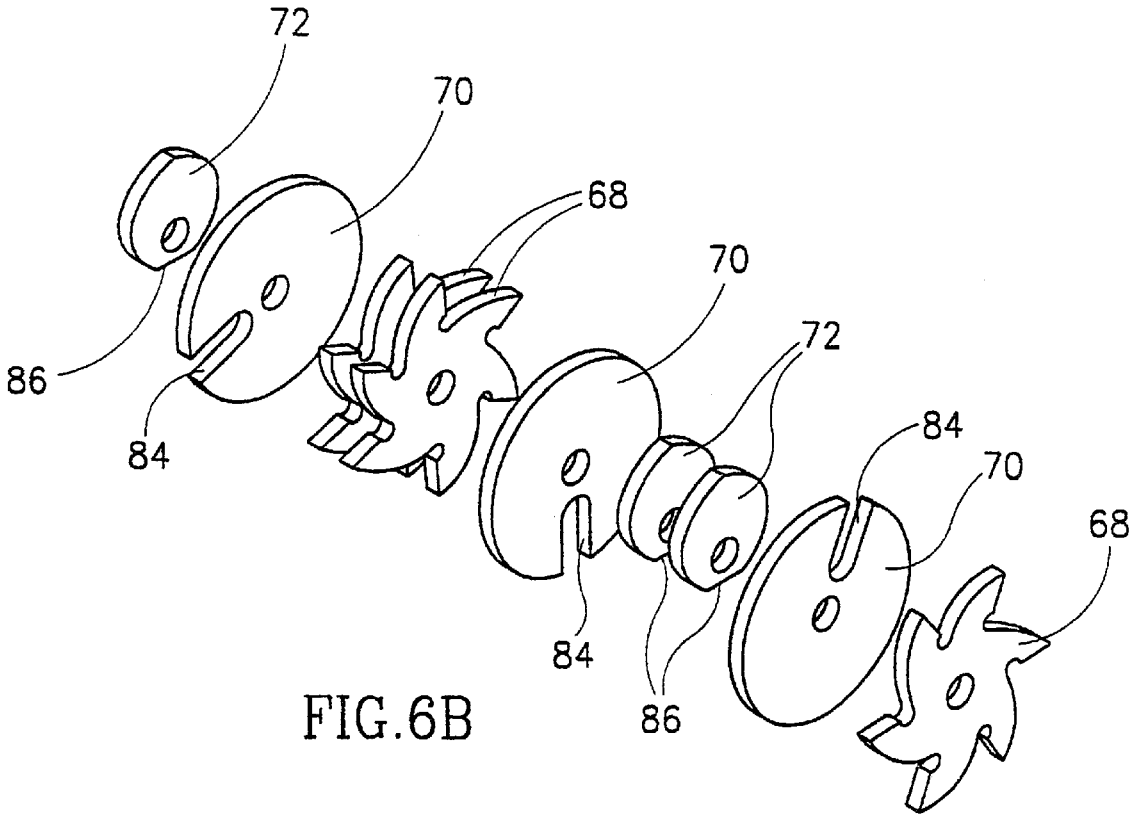
FIG. 6B is an exploded view of the locking assemblies in their resetting position.

Turning now to FIG. 8B, the lock is in its resetting position, in which the shackle 40 is depressed in the direction of arrow 150, whereby the upper edge 152 of groove 51 of the shackle encounters the upper surface of the spring tongue 146, resulting in counter-clockwise rotation of locking member 90, whereby the second engaging tongues 96 and 98 engage with the respective reset elements 86, forcing them to rotate, either clockwise or counter-clockwise, depending on their momentary position, to a position in which all the flat surfaces 86 become flush with the top surface of the second engaging fingers 96 and 98, respectively. In FIGS. 6 the locking mechanism 56 is seen in the reset position, where in FIG. 6B it can be seen that the flat surface 86 of all the reset elements 72 are arranged at the same orientation. i,e the flat surface 86 facing downward.

The so-called reset position is, in fact, a zeroing position, which is so calculated that upon applying a series of angular displacements to the locking assemblies, which constitute an opening combination of the lock, then only the peripheral openings 84 of the locking discs 70 will become all aligned and enable opening of the lock, as will hereinafter be explained.

After resetting the lock, as explained in connection with FIG. 8B, the manipulating knob 104 is displaced within the opening 106 of the front wall 30, in a predetermined consecutive series of displacements. Each time an inclined end 114 of a displacement blade 110 or 112 encounters an arced surface 78 of a tooth 76 of a cogged wheel 63, it will entail clockwise displacement of the cogged wheel with the displacement blade gliding over the corresponding arced surface until a flat surface 80 of a following tooth encounters the displacement blade. The position seen in FIG. 8C, shows the displacement blade 110*a* (at the bottom left comer of the lock) after having disengaged from a radial, flat wall 80 of a tooth and then the displacement blade 110*b* (at the bottom right comer of the lock) is displaced into encountering the arced surface 78 of the following tooth 76', entailing displacement of the cogged wheel 68 to rotate clockwise to the position seen in FIG. 8D, in which the displacement blade 110*b* encounters the radial flat wall 80''' of a next tooth 76''.

FIGS. 8C and 8D illustrate also how the manipulating frame 100 is biased into its normal position. As seen in the Figures, the displacement blade 110*b* and the corresponding, diagonally opposed displacement blade 110*c* (at the top, left corner) are freely displaced along the direction of arrow 130. However, such displacement entails displacement blades 110*a* and 110*d* to bear against the arms of springs 122, applying in return a biasing effect tending to displace the manipulating frame (not seen) to its normal position.

Obviously, the above description refers to a specific configuration in which the opening combination consists of a series of movements, including displacement into position "A" and then into position "D", as illustrated on the front wall 30 and seen in FIG. 1. It should be, however, understood to a person versed in the art that the number of displacements of the manipulating knob 104 may vary and the number of combinations is practically endless, depending, among others, on the configuration of the cogged wheels and the predetermined fixed angular position of the three components of each of the locking assemblies. However, in practice it is found that an opening combination comprising at least three manipulation displacements provides adequate security effectiveness.

After completing manipulation of the manipulating knob 104, in accordance with the specific opening combination of the lock, all three peripheral recess 84 of the three locking discs 70 become aligned, facing the first engaging fingers 94, as seen in FIG. 8D and in FIGS. 7. Consequently, upon pulling the shackle 40 in the direction of arrow 160 seen in FIG. 8E, the spring tongue 146 of the locking element 90 encounters the bottom wall 162 of groove 51 of the shackle 40, whereby it is rotated in a counter-clockwise direction, entailing engagement of the first engaging fingers 94 into the aligned recesses 84 of the locking discs 70. In this position the locking latches 48 disengage from the locking lugs 140 and enable extracting of the shackle 40 until ring 46 encounters wall 166 of the housing 20, preventing further extraction of the shackle, but the shackle 40 may be rotated about its longer leg 44 as known, per se. The chamfered edges of the locking latches ensure smooth disengagement of the locking lugs from the locking latches. Obviously, if so desired, the ring 46 of the shackle 40 may be omitted, whereby the shackle may be removed from the housing.

When it is now required to lock the padlock, the short leg 42 is aligned with aperture 36 of the housing 20 and the shackle 40 is depressed in the direction of 150, as in FIG. 8B, whereby the leaf spring 146 will cause the locking member 90 to rotate in a counter-clockwise direction, such that the locking lugs 140 are positioned above the locking latches 48 in a locking position and the locking mechanism is automatically reset, as explained hereinabove.

Figure 9B:
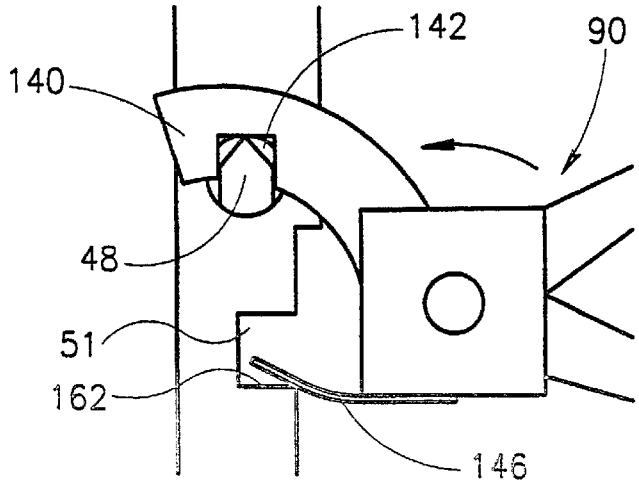
FIG. 9B is an enlargement of the locking latch and locking lug of the lock.

As can be seen in FIG. 9A, the lock is in its locked position and any attempt to pull the shackle 40 in the direction of arrow 168 causes rotation of the locking member 90 in a counterclockwise direction (as a result of spring tongue 146 encountering bottom wall 162 of groove 51), whereby the lugs 48 become engaged within recess 142 of the locking lugs 140 (as seen in enlarged scale in FIG. 9B). In this position it is ensured that excessive force applied to the shackle is not transmitted to the locking assemblies, owing to arrangement which prevents contact of the first and second engagement teeth from the components of the locking assemblies, as clearly seen in FIG. 9A.

It will be appreciated by a skilled person that the lock may be designed such that the lock may be opened using more than one manipulating combination. This arrangement is an important advantage in that the lock may serve as a personal lock on the one hand, and on the other hand serve as a master-lock. An example of use of such a lock is at school, where each pupil has his personal locker with a pad lock and a personal manipulating combination for that lock, and where the school's janitor is authorized to the lockers using a master combination preset for all the pad locks.

In accordance with another embodiment (not shown), the cogged wheels may be produced with both faces of each tooth being curved. In such a case the edges of diagonally opposed displacement blades each extend at a different plane in order to avoid clamping of the blades (which might occur in case of teeth formed with a radial face and displacing blades extending at the same plane). The blades may extend from respective corners of a box-like frame fitted within the housing, mutatis mutandis.

Attention is now directed to FIGS. 10 to 13, illustrating a different embodiment of a padlock, in accordance with the present invention, in which the opening combination is changeable by an authorized user. For sake of clarity, those elements which are principally similar to those described with reference to FIGS. 1–9 are designated by the reference number, with the additional offset of 200.

Figure 10:
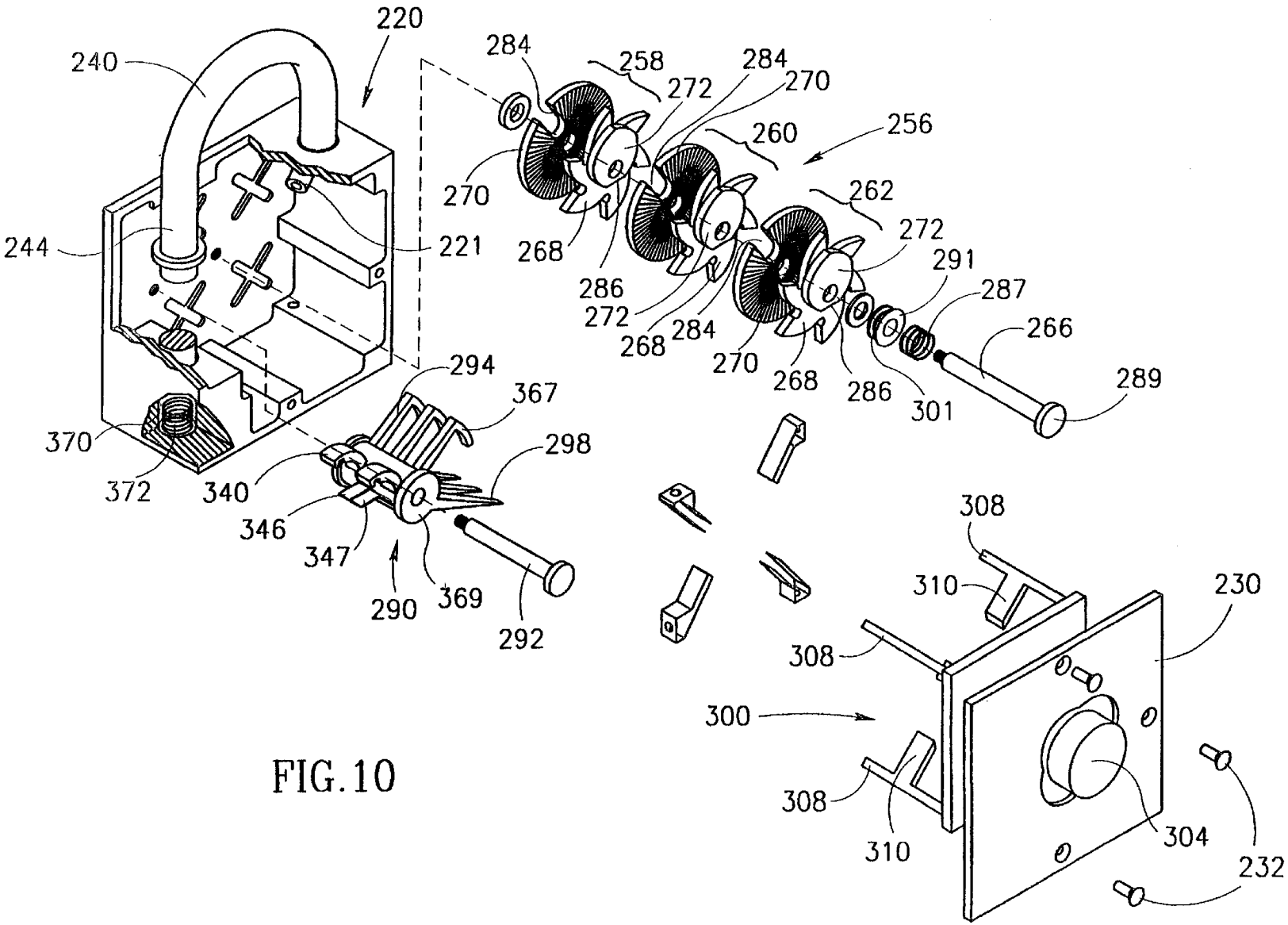
FIG. 10 is an perspective exploded view of a padlock in accordance with a second embodiment of the present invention, with the housing partially cut out.

The embodiment seen in FIG. 10 differs from the previous embodiment in that the combination for opening the lock may be changed at user's will. In this embodiment the housing 220 is similar to the housing of the previous embodiment, but comprises a guiding tube 221 which can be seen also in FIG. 12, the purpose of which will become apparent hereinafter. The locking mechanism 256 consists of three locking assemblies 258, 260 and 262, each comprising a cogged wheel 268 integrally formed with a reset element 286, and a locking disc 270, having a peripheral, radially extending recess 284. In each locking assembly one face of the locking disc 270 and a corresponding face of the cogged wheel 276, comprise a plurality of radial teeth adapted for co-engagement at different angular displacements, as will be explained hereinafter. The locking assembly 256 is mounted on a shaft 266 and is biased into a position in which each locking disc 270 is engaged with its respective cogged wheel 276 by a coiled spring 287 mounted on shaft 266 and bearing at one end against a head 289 of the shaft 286, and at an oppose end against a ring 281. Ring 281 is formed with an annular recess 301 and an inclined surface 305 (seen in more detail in FIG. 11).

Figure 11A:
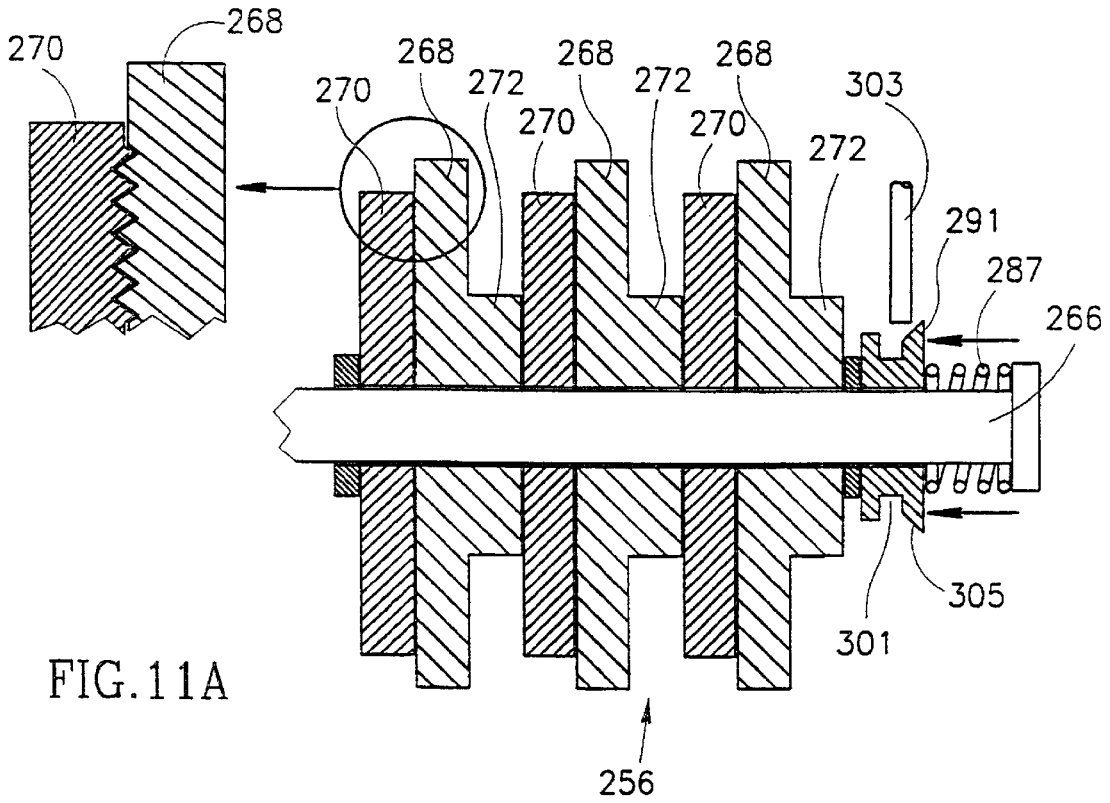
FIG. 11A is a cross-section trough the locking assemblies of the lock according to the second embodiment, in their operable position.
Figure 11B:
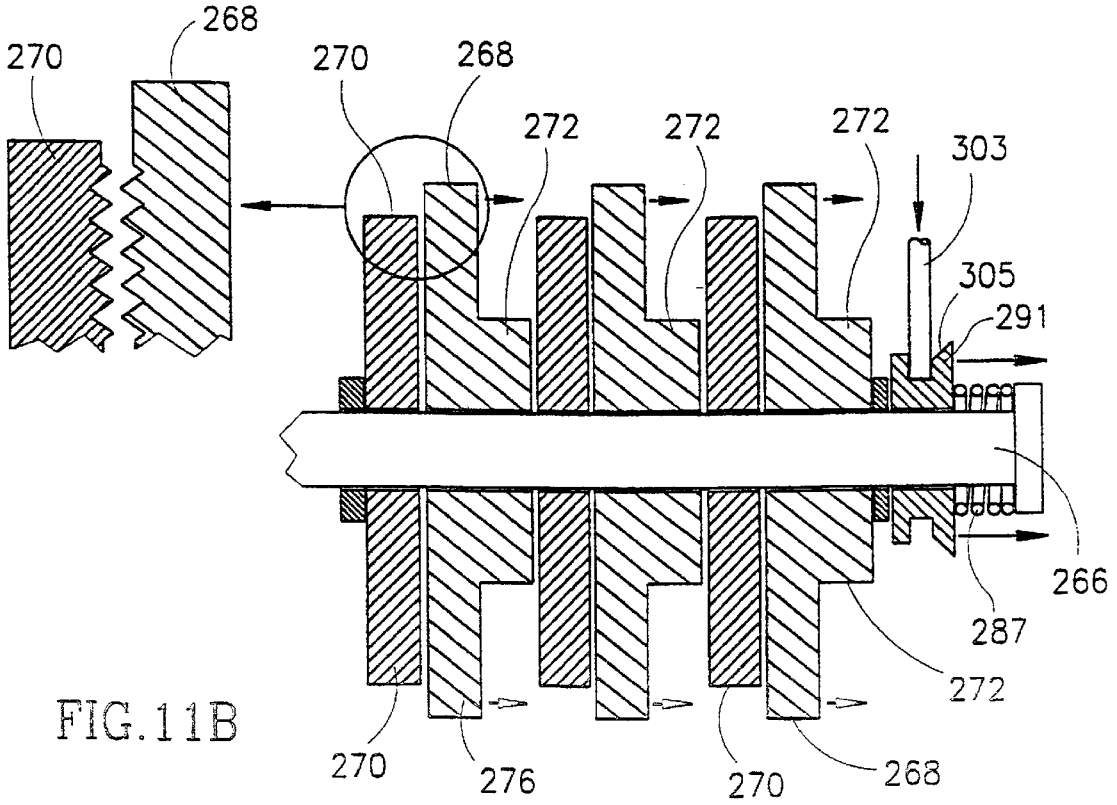
FIG. 11B cross-sectional view of the locking assemblies of the lock according to the second embodiment, in an expanded position for setting a new opening combination.

FIG. 11A illustrates the locking mechanism 256 in a position in which the locking discs 270 are engaged with their respective cogged wheels 268, and FIG. 11B illustrates a position in which a displacement rod 303 displaces the ring 291 along the shaft 266, against the biasing effect of the coiled spring 287, allowing disengagement of the locking discs 270 from their respective cogged wheels 268, whereby each element can be angularly disposed irrespective of the other components.

The lock further comprises a forked locking member 290, pivotally fixed to the housing 220 by shaft 292. As can further be seen in FIGS. 11A and 11B, the forked locking member 290 is assembled of a core member 365 formed with two locking lugs 340, each formed at its bottom surface with a locking recess 242, adapted for locking engagement with corresponding locking latches 248 of shackle 240 (only one of which is seen in FIGS. 14). Rigid with the core member 365 are three hook-like shaped first engagement fingers 294, each having a hooked end 367. Core member 365 is also fitted with a first rearward projecting leaf spring 346. Coaxially mounted over shaft 292 (seen in FIG. 10) are two support brackets 369 supporting the second engagement fingers 293, and a second rearward projecting leaf spring 347 supported by an arm 349 extending from one of the brackets 369. The arrangement being such that the support brackets with the associated second engagement fingers 298 and the second leaf spring 347 are together, rotatable with respect to core member 365, and its associated elements.

FIGS. 13A–13E of the drawings illustrate the longer leg portion 244 of the shackle 240. As seen in FIGS. 13A and 13B and in the respective cross-sections, the leg portion 244 has three recessed areas defined in sections C—C, D—D and E—E, each section adapted for corporation with one or both of the first and second leaf springs 346 and 347, respectively, as will hereinafter be explained in detail with reference to FIGS. 14.

Figure 14B:
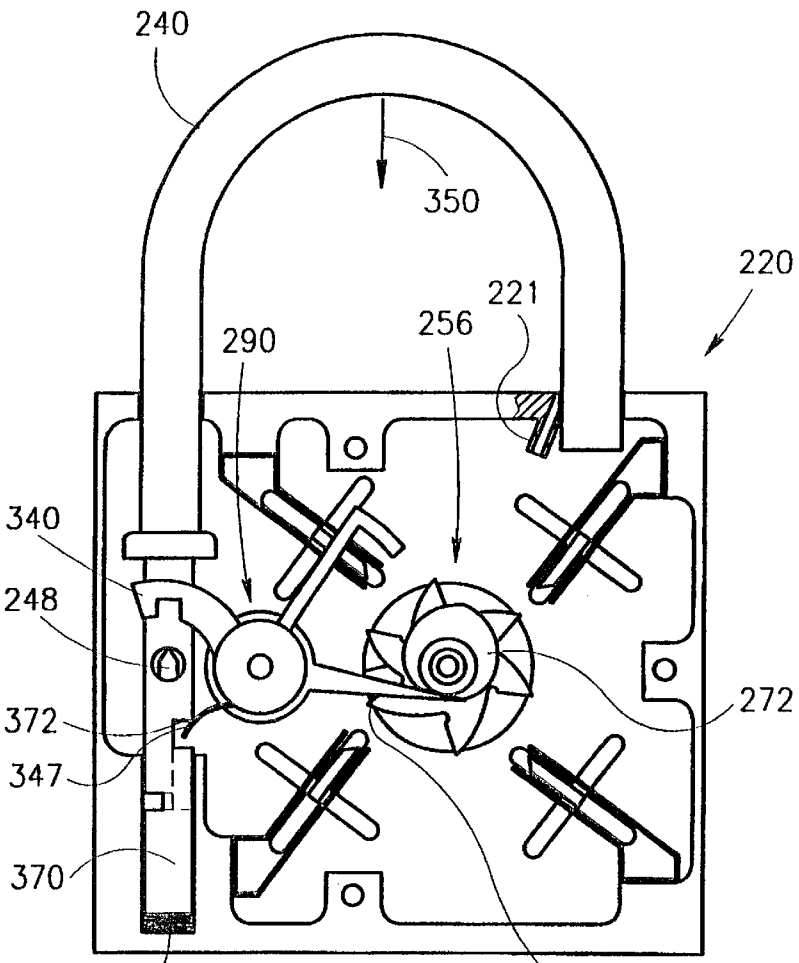
FIGS. 14A to 14G are front elevations of the padlock seen in FIG. 10, with the front wall and manipulating plate removed, illustrating consecutive steps of opening the lock and setting a new opening combination.
Figure 14A:
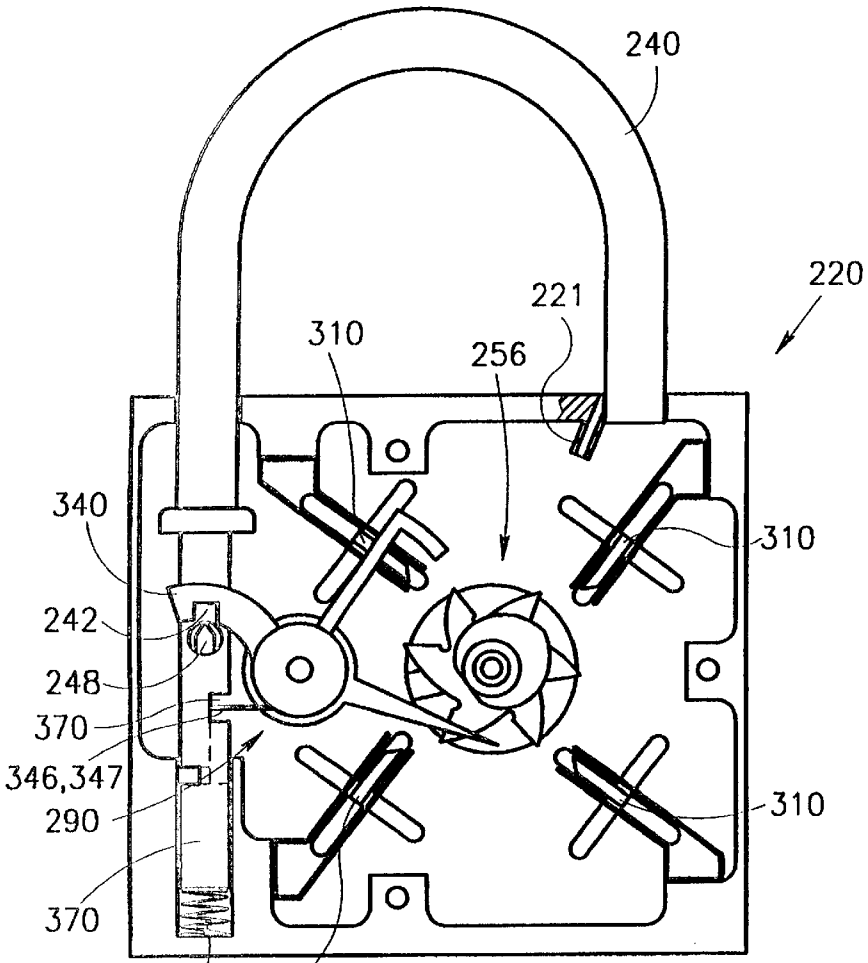

In the embodiment of FIG. 10, the housing comprises a cavity 370, comprising a coiled compression spring 372, for upwardly biasing the shackle 240 within the housing 220, into the position seen, for example, in FIG. 14A. As it will be realized by the artisan, the embodiment of FIG. 1 may also be fitted with such a spring.

The other components of the lock seen in FIGS. 10–14 are similar in construction and operation as in those seen in connection with the first embodiment, as illustrated in FIGS. 1–9, and no further explanation is required.

Attention is now directed to FIGS. 14A–14G, illustrating different operative positions of the lock, in accordance with the second embodiment, in which FIG. 14A illustrates the lock in a locked position, in which the locking mechanism 256 is in an arbitrary position, i.e. a position in which the recesses 284 of the locking discs 270 are not aligned and do not face the hooked arms 367 of the first engaging fingers 294. In this position, both leaf springs 346 and 347 are received within recess 370 of the shackle at an essentially horizontal. non-deflected, position. Furthermore, in the locked position, the locking recess 242 of the locking lugs 348 is above the locking latches 243 of shackle 240. and it is thus not possible to extract the shackle from the housing 220.

Prior to manipulating the locking mechanism 256, it should be reset in the same manner as explained in connection with the first embodiment. As seen in FIG. 14B, the shackle 240 is depressed in the direction of arrow 350, entailing the second leaf spring 347 of the forked locking member 290 encounters top surface 372 of the recess 370 of the shackle portion 244, thereby entailing a counter-clockwise displacement of the support brackets 369 with the associated second engagement fingers 298 engaging with the reset elements 272, entailing their rotation into a reset position, wherein the flat surfaces 286 are flush with the upper surface of the second engaging fingers 298.

Figure 14D:
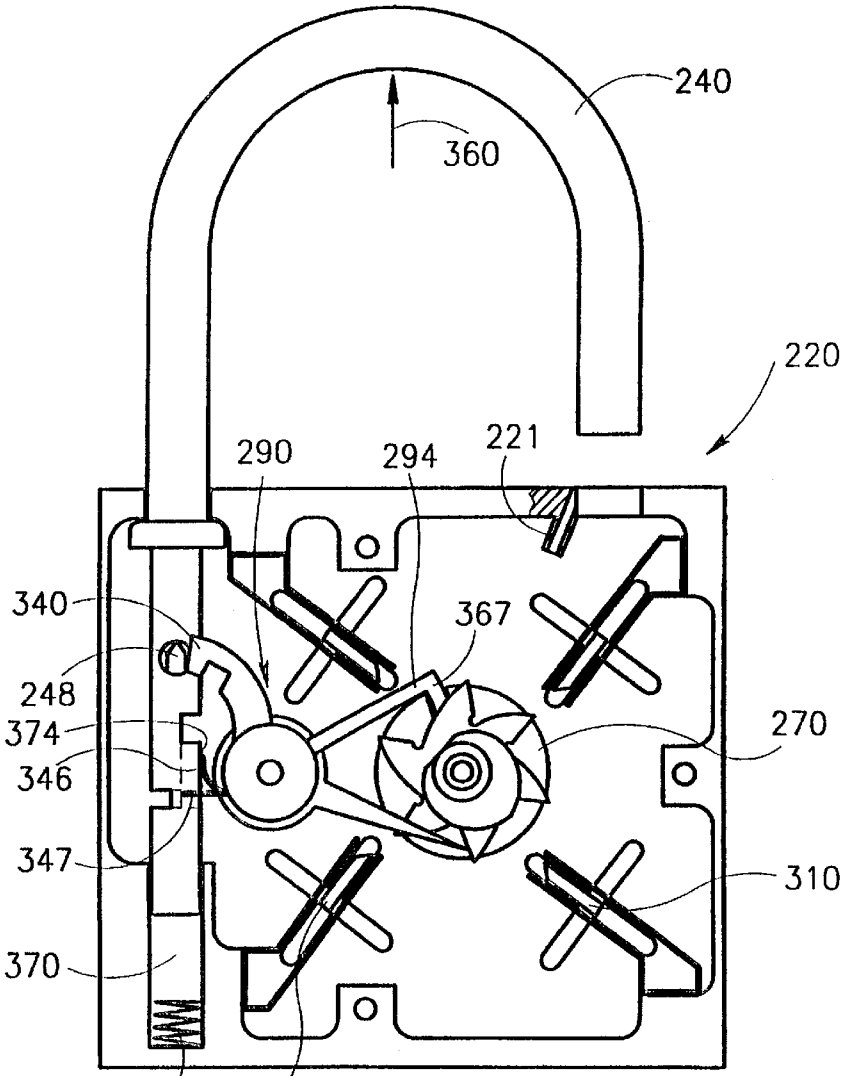
Figure 14C:
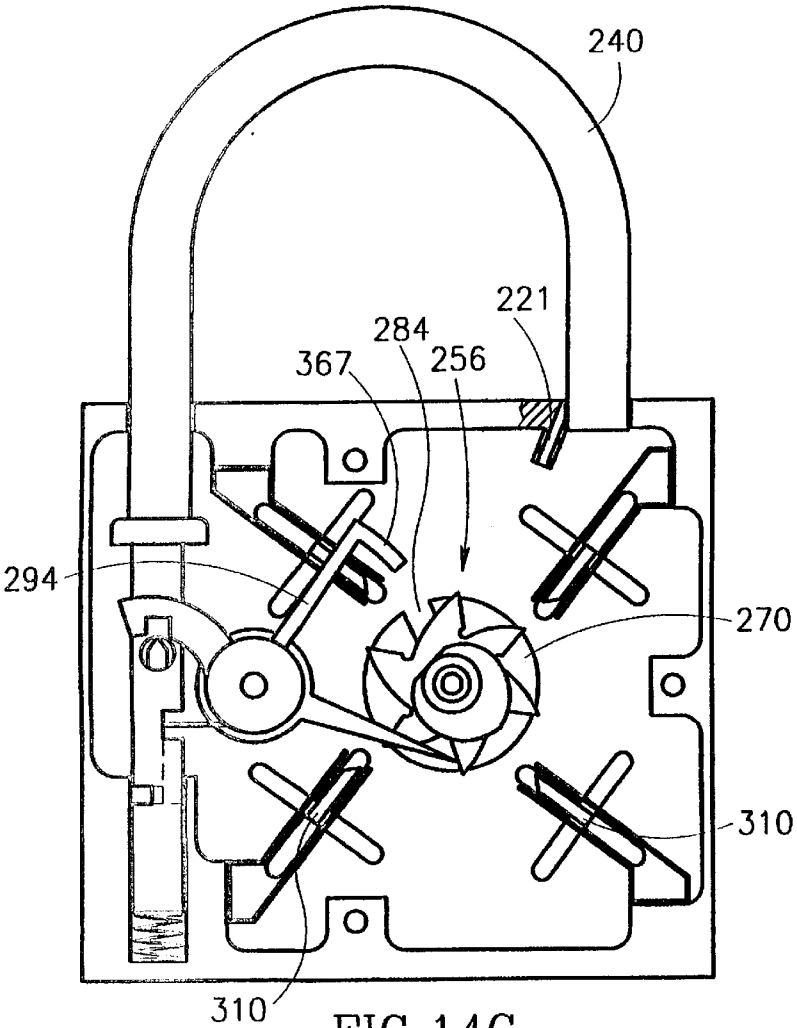

Then, the manipulating frame 300 (seen in FIG. 10) is manipulated by manipulating knob 304, as explained in connection with the previous embodiment. In consequence of the manipulation, the displacement blade 310 cause the locking mechanism 256 to rotate into the open position, wherein all the peripheral recesses 284 of the locking discs 270 become aligned and in position for engagement with the hooked portions 367 of the first engaging fingers 294, as seen in FIG. 14C. Then, upon pulling the shackle 240 in the direction of arrow 360, the first leaf spring 346 encounters cylindrical surface 374 of the shackle and is deflected, as seen in FIG. 14D, entailing clockwise displacement of the forked locking element 290, whereby the hooked portion 367 of the first engaging fingers 294 engage with the recesses 284 of the locking discs 270, thus disengaging the locking latches 248 from the locking lugs 340, so that the shackle can be extracted to the open position as seen in this Figure. It will be appreciated that while pulling the shackle in this position, the second leaf sparing is received within groove 376 where it does not encounter any surface and remains un-deflected, as seen in FIG. 14D.

Locking of the padlock in accordance with this embodiment is obtained by depressing the shackle 240, as in FIG. 14B, whereby the forked locking member 290 rotates in a counter-clockwise direction, entailing the locking lugs 340 to extend above the locking latches 248, preventing extraction of the shackle 240.

Figure 14E:
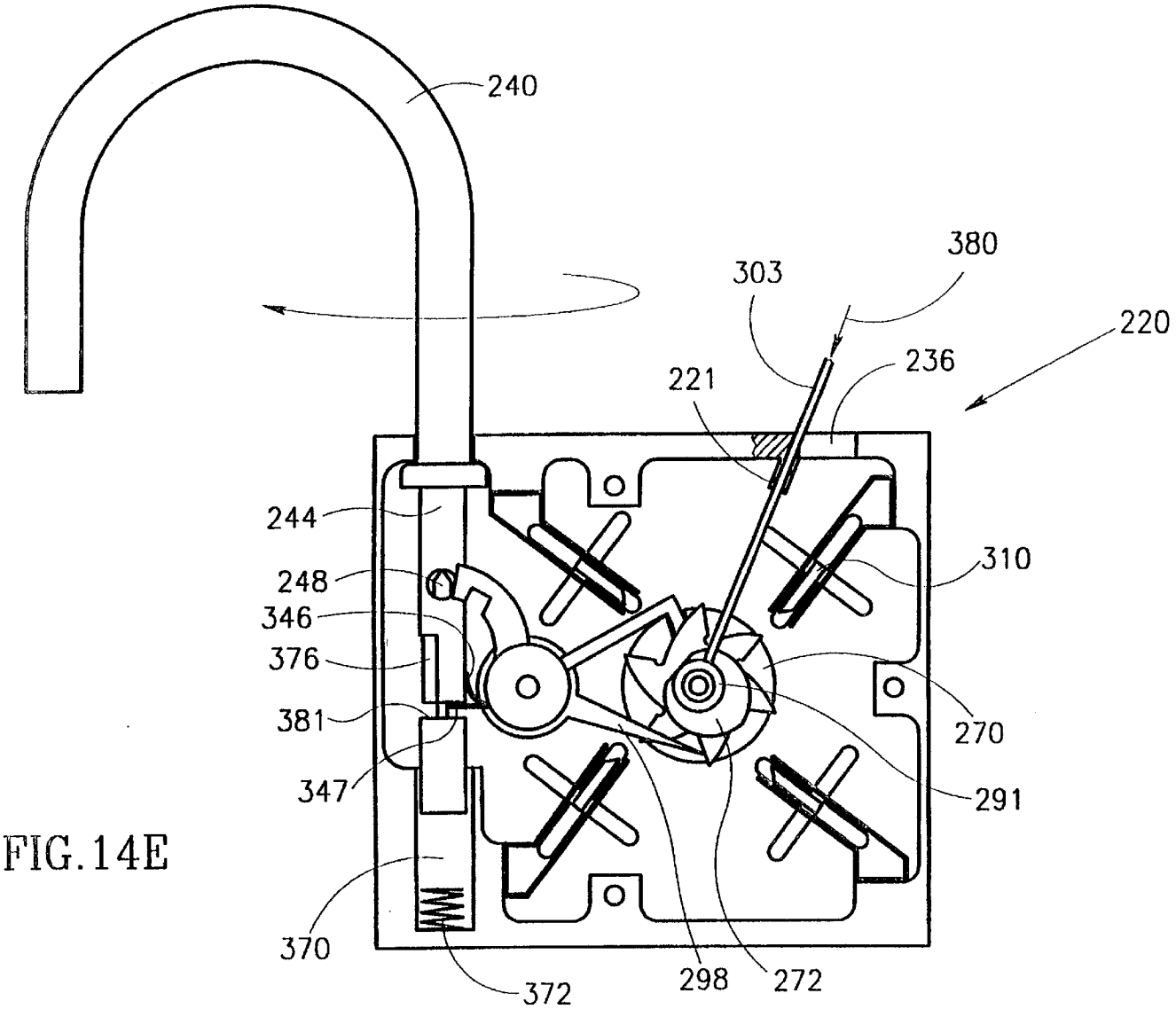
Figure 14F:
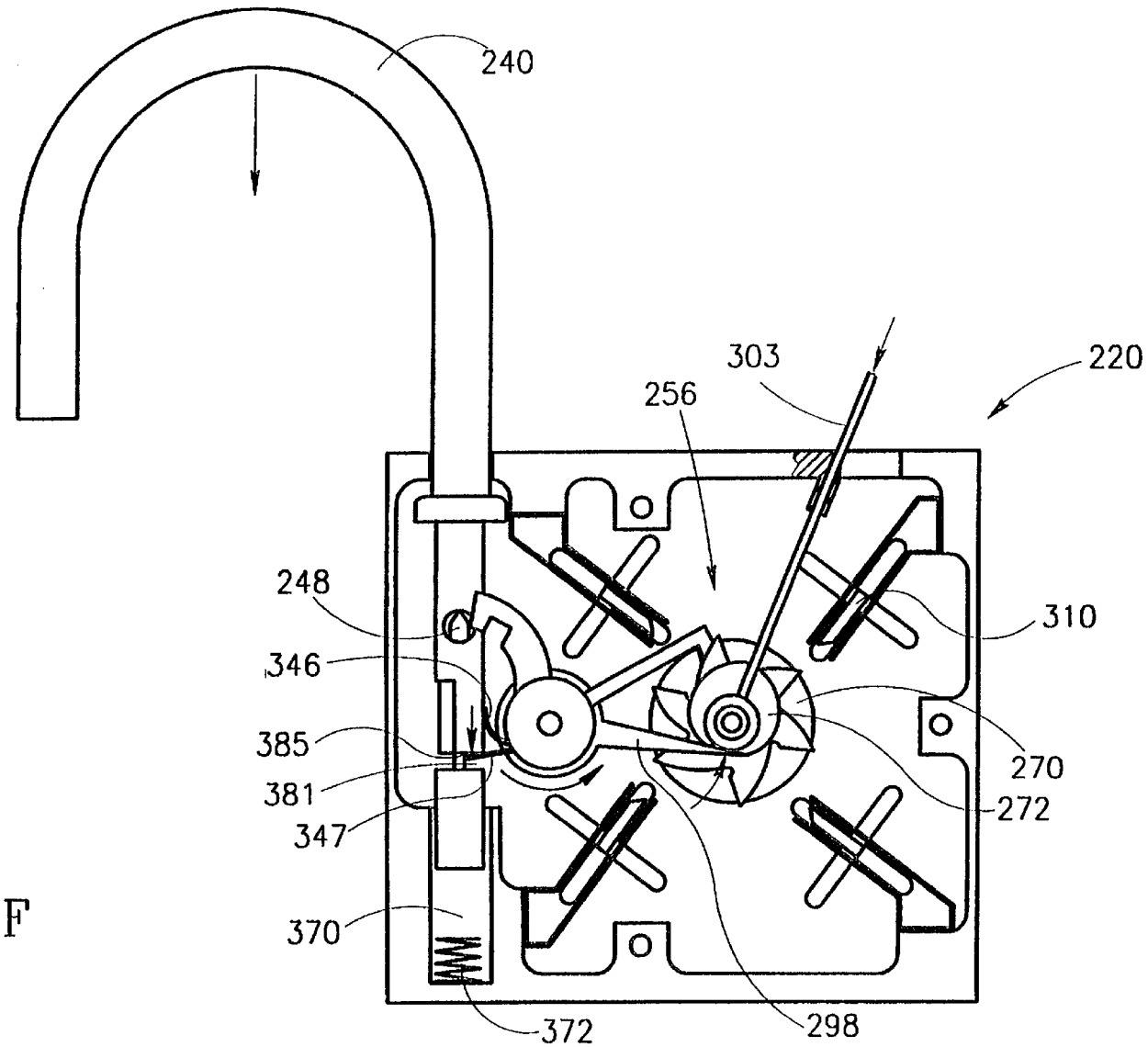
Figure 14G:
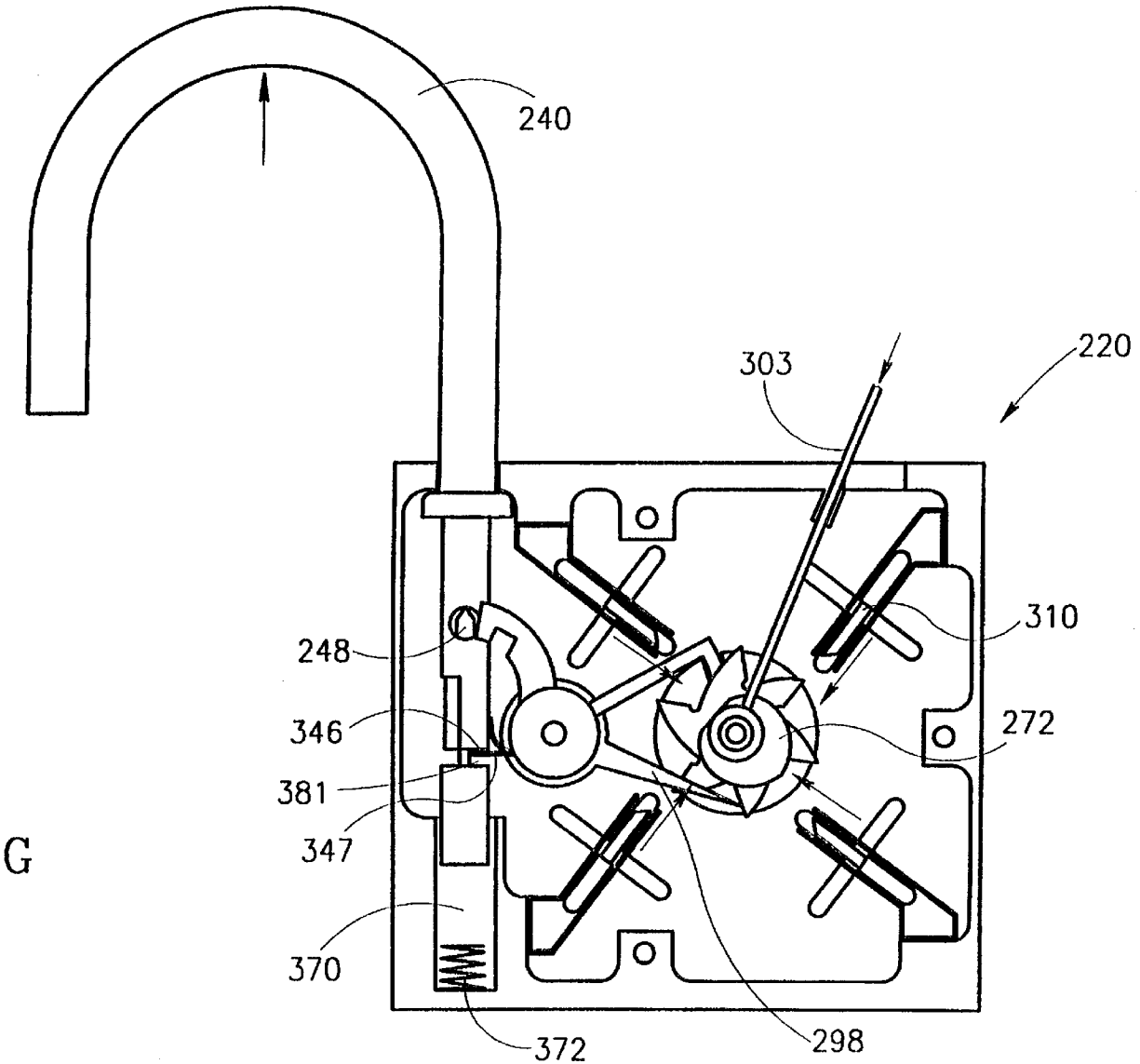

Further attention is now directed to FIGS. 14E–14G for understanding how the combination of the opening combination may be changed at owner's will. In order to change the opening combination, the lock has to be opened and the shackle 240 has to be rotated to the position of FIG. 14E. This important step ensures that only an authorized person who knows the original opening combination will have access to changing the combination.

In the position of FIG. 14E, the first leaf spring 346 bears against the cylindrical surface of shackle leg 244, ensuring constant engagement of the first engaging fingers 294 with the recesses 284 of the locking discs 270, and where the second leaf spring 347 is un-deflectedly received within recess 381 of shackle portion 244, whereby the second engaging fingers 298 are disengaged from the reset elements 272.

After opening the lock, a suitable resetting rod 303 is inserted via opening 236 of the housing 220 into the guiding tube 221, guiding the resetting rod 303 towards the ring 291 to the position seen in FIG. 11A, in which it encounters the inclined surface 305. Upon applying pressure in the direction of arrow 380, the resetting rod 303 displaces ring 291 against the biasing effect of the coiled spring 287 (see FIG. 11B), thus allowing axial displacement of the locking discs 270 and the respective cogged wheels 268, so as to disengage from one another. Then, while still in the rotated position, the shackle 240 is depressed (as seen in FIG. 14F), whereby the first leaf spring 346 remained in a deflected position biasing the first engagement fingers 294 into engagement with the locking discs 270 and the second leaf spring 347 encounters the upper surface 385 of groove 381 of the shackle (see FIG. 13A), entailing counter-clockwise rotation of the second engaging fingers 298, causing rotation of the reset elements 272 to the reset position, as already explained hereinabove. During this step, the resetting rod 303 remains depressed in a position, allowing free rotation of the components of the locking mechanism 256.

Then, as illustrated in FIG. 14G, the shackle 240 is extracted to its upper position, whereby the first leaf spring 346 remains in its biasing position as in FIG. 14F, and the second leaf spring 347 becomes free within recess 381 of the shackle portion 244, thus disengaging the second engaging fingers 298 from the reset elements 272. While the resetting rod 303 is still in its depressed position, a new opening combination is set by manipulation of the manipulating knob 304 in a new series of displacements, constituting the new combination, at user's will. The resetting rod 303 is then removed from the lock and the shackle 240 is rotated back to the closing position and depressed into a locking position. Opening the lock is as explained hereinabove by using the new manipulating combination.

It will be readily understood that the length of the combination set may be changed each time the authorized user changes the manipulating combination, i.e. the number of displacements of the manipulating knob required for opening the lock. This arrangement renders the lock a higher security ranking as it significantly increases the number of false combinations.

It will also be appreciated that the unique construction of the lock according to the present invention is suitable for mass-production since the manipulating combination may be set at any stage after manufacture, regardless the specific shape and design of the components of the locking assemblies.

While the embodiments illustrated in FIGS. 1–14 are all directed to a pad lock, it should be obvious that a variety of locks utilizing the combination locking mechanism described hereinabove.

Figure 15A:
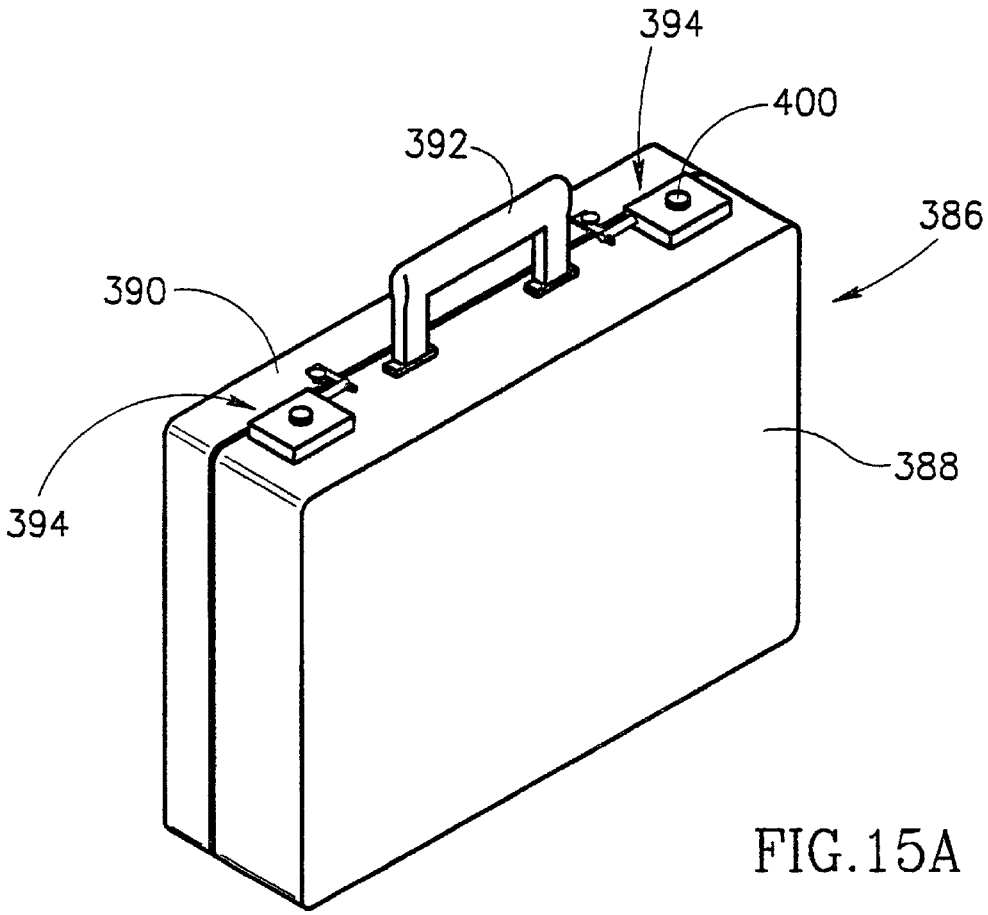
FIG. 15A shows a briefcase in perspective view, comprising a locking mechanism according to the present invention.
Figure 15B:
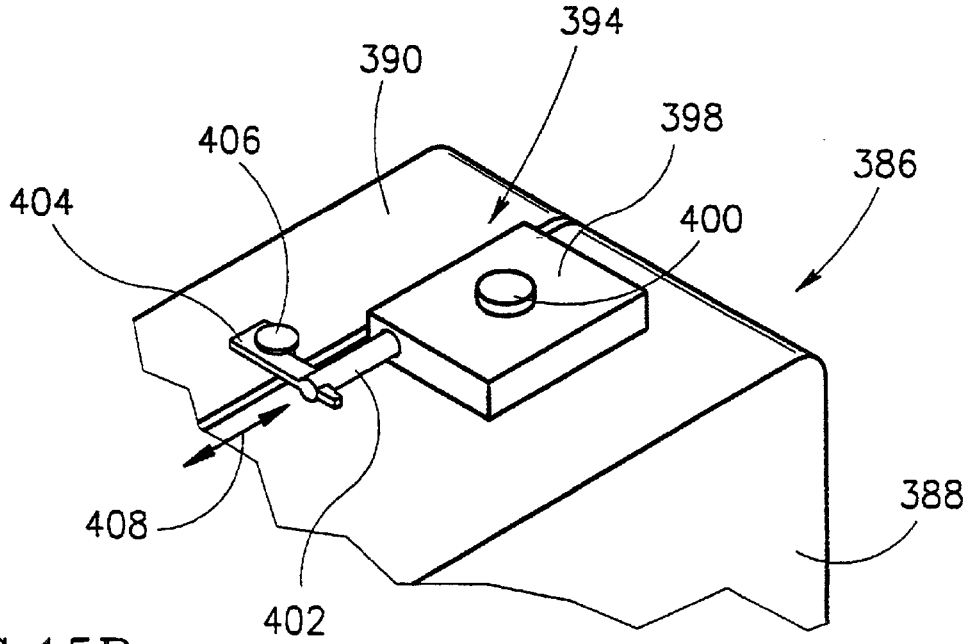
FIG 15B is an enlarged portion of the briefcase of FIG. 15A.

Turning now to FIG. 15 there is seen a briefcase generally designated 386 having a base member 388 and a cover member 390 swinconnected to one another at respective bottom walls, a carrying handle 392 and two locking assemblies 394 fixed to the base member 308. Better seen in FIG. 15B, each locking assembly comprises a housing 398 accommodating a locking assembly (not seen) similar to that explained in connection with the previous embodiments and being fitted with a manipulating knob 400. instead of a U-like shaped shackle the locking element is in the form of a locking rod 402 slidingly received within the housing 398 and having a locking arm 404 fixed thereto, forming together an L-like shape. The locking arm 404 has a recess (not seen) adapted for arresting a locking knob 406 fixed to the cover member 390.

The arrangement is such that the locking rod is axially displaceable within the housing as indicated by arrow 408, but can not be removed (e,g. as explained in connection with the embodiment of FIG. 1). For opening the briefcase the locking mechanism should first be reset by depressing the locking rod 402 (entailing resetting as explained hereinabove in connection, for example with FIG. 8B). Than, the manipulating knob 400 is manipulated at the correct sequence in accordance with the opening combination so that the locking rod 402 may be slightly pulled, allowing disengagement of the locking arm 404 from the locking knob 406, whereby the briefcase may be opened. Locking the briefcase is obtained by simply closing the case and depressing the locking arm 404 into engagement with the locking knob 406.

As explained hereinabove in connection with the second embodiment (FIGS. 10–14), the opening combination of the. lock may be changed at will. However, the lock has a further advantage in that a user may wish to rename the displacement locations establishing a new opening code, in accordance with some personal preference, so as to make it easier to remember the opening code. This may be carried out by simply applying some characters (letters ore numbers) on the front wall (instead of letters A-D, see FIG. 1), which new characters form a combination which has some meaning only to the that person, e,g. an Identification Number, a birth date, etc.

It should be appreciated that the locking mechanism according to the present invention is made to meet also the high level security standards, although its easy and essentially fast manipulation (typically about 2–3 seconds to open). The lock can not be picked at by conventional means (such as applying a stethoscope to a standard dial combination lock to locate its opening positions). Nevertheless, the locking mechanism is suitable for serving in master locks, and even more so. additional locks having the same opening combination may be easily introduced by adjusting their opening combination as explained.

In addition, the lock offers some other serious advantages which are not known with prior art locks, namely, it is possible to manipulate the lock at complete darkness and single handed(both being serious advantages for blind or amputated people) and even while wearing gloves.

It will be appreciated by the artisan that the locking assembly with which the invention is concerned is useful, mutatis mutandis, for a variety of other applications, e,g. doors, windows, vehicle doors, lockers. etc.

What is claimed is:

1. A combination lock mechanism comprising:

a housing, a locking element fitted with a locking latch and extending into the housing, at least two coaxially disposed rotatable locking assemblies each comprising a cogged wheel, a locking disk formed with a peripheral recess and being fixable to the cogged wheel, and a reset element fixable to the cogged wheel;

a forked locking member pivotally secured within the housing and fitted with first engaging fingers, each adapted for engagement with the peripheral recess of a corresponding locking disk, second engaging fingers, each adapted for engagement with a corresponding reset element, and a locking lug for locking engagement with the locking latch of the locking element;

the forked locking member being displaceable between a locking position in which the locking lug arrests the locking latch, an opening position in which each of the first engaging fingers is engaged within the peripheral recess of a corresponding locking disk and the locking lug disengages from the locking latch, and a reset position in which each of the second engaging fingers engages a corresponding reset element entailing displacement thereof into a reset position;

a manipulating frame displaceable within the housing and comprising at least two arms, each arm fitted with displacement blades each corresponding with one of the cogged wheels, the arrangement being such that upon predetermined consecutive displacements of the manipulating frame the displacement blades encounter teeth of a respective cogged wheels entailing respective angular displacement of each of the at least two rotatable locking assemblies into a position in which all the peripheral recesses are aligned, thus allowing the forked locking member to shift into the opening position.

2. A combination lock mechanism according to claim 1, wherein the manipulation frame is manipulated by a single manipulating knob projecting from a front wall of the housing.

3. A combination lock mechanism according to claim 1, being a padlock and wherein the locking element is a shackle.

4. A combination lock mechanism according to claim 1, wherein at the opening position the forked locking member is biased in a direction enabling the first engaging fingers to engage within the peripheral recess of the corresponding locking discs: and at the resetting position the forked locking member is biased in a direction so that the second engaging fingers engages the corresponding reset elements.

5. A combination lock mechanism according to claim 4, wherein the forked locking member is fitted with a leaf-spring received within a corresponding recess in the locking element, whereby extracting displacement of the locking element from the housing entails biasing of the forked locking member into the opening position; and retracting displacement of the locking element with respect to the housing entails biasing of the forked locking member into the resetting position.

6. A combination lock mechanism according to claim 1, wherein the manipulating frame is biased into a neutral position in which the displacement blades are disengaged from the teeth of the cogged wheels.

7. A combination lock mechanism according to claim 6, wherein at least two non-diagonally disposed arms of the manipulating frame are each biased by a spring member fixed to the housing in a manner so as to allow displacement of the respective arm along a first axis, and bias the manipulating frame into the neutral position when displaced along a second axis perpendicular to said first axis.

8. A combination lock mechanism according to claim 2, wherein the manipulating frame is displaceable in a cross-like pattern.

9. A combination lock mechanism according to claims 8, wherein the front wall of the housing is formed with a cross-like aperture allowing displacement of the manipulating knob in a cross-like pattern.

10. A locking arrangement including a combination lock mechanism according to claim 1, wherein at least one of the housing and the locking element are assembled on a swingable member of a case or a door or the like.

11. A combination lock mechanism according to claim 1, wherein the lock comprises three rotatable locking assemblies and the manipulating frame comprises four arms.

12. A combination lock mechanism according to claim 1, wherein each reset element is formed in a drop-like shape having a flat base, where engagement with the second engaging fingers of the forked locking member, at any angular position, entails rotation of the reset element to a position in which said fingers are flush with said flat base.

13. A combination lock mechanism according to claim 1 wherein at the locked position, the first and second engaging fingers are disengaged from the locking discs and the reset elements, respectively, whereby force applied to the shackle is not transmitted to the locking assemblies.

14. A combination lock mechanism according to claim 1, wherein the locking latch of the locking element has a pointed end facing the locking lug of the forked locking member.

15. A combination lock mechanism according to claim 8, wherein a back wall of the housing is formed on an inner face thereof with a supporting cross-like groove corresponding with each arm of the manipulating frame and corresponding in shape with the displacement thereof.

16. A combination lock mechanism according to claim 1 wherein the three components of each locking assembly are integral with one another.

17. A combination lock mechanism according to claim 1 wherein one of the cogged wheel and the locking disc and the resetting element of at least one of the rotatable locking assemblies is angularly displaceable with respect to the others so as to establish a new opening combination.

18. A combination lock mechanism according to claim 17, wherein the opening combination may be changed only at an open position of the lock.

19. A combination lock mechanism according to claim 17, wherein at each locking assembly the reset element is displaced with respect to the locking disc.

20. A combination lock mechanism according to claim 19, wherein the at least two rotatable locking assemblies are mounted on a shaft and are spring biased into rotation engagement.

21. A combination lock mechanism according to claim 20, wherein the reset elements are disengaged from the locking elements by a displacement rod introduced through an opening in the housing.

22. A combination lock according to claim 1 wherein teeth of the cogged wheel are curved at one or both edges thereof, and where the edges of diagonally opposed displacement blades each extend at a different plane.

* * * * *